US007823518B2

(12) United States Patent
Phillips

(10) Patent No.: US 7,823,518 B2
(45) Date of Patent: Nov. 2, 2010

(54) COMPUTER DESK

(75) Inventor: Thomas L. Phillips, Dexter, MI (US)

(73) Assignee: Conceptual Furniture, LLC, Dexter, MI (US)

( * ) Notice: Subject to any disclaimer, the term of this patent is extended or adjusted under 35 U.S.C. 154(b) by 612 days.

(21) Appl. No.: 11/568,952

(22) PCT Filed: May 10, 2005

(86) PCT No.: PCT/US2005/016225

§ 371 (c)(1),
(2), (4) Date: Nov. 10, 2006

(87) PCT Pub. No.: WO2005/110152

PCT Pub. Date: Nov. 24, 2005

(65) Prior Publication Data

US 2007/0227408 A1 Oct. 4, 2007

Related U.S. Application Data

(60) Provisional application No. 60/569,697, filed on May 10, 2004.

(51) Int. Cl.
*A47B 23/00* (2006.01)
*A47B 37/00* (2006.01)
*A47B 9/20* (2006.01)

(52) U.S. Cl. ..... 108/43; 108/144.11; 108/147.21

(58) Field of Classification Search ..... 108/43, 108/144.11, 147.19, 147.21, 49, 116, 147.2, 108/147.22, 154, 1, 9, 10, 6; 248/188, 188.1, 248/188.5, 188.6, 188.2, 149, 354.1
See application file for complete search history.

(56) References Cited

U.S. PATENT DOCUMENTS

| | | | |
|---|---|---|---|
| 2,150,397 | A | 3/1939 | Owen |
| 2,828,589 | A | 5/1954 | Hercik |
| 4,248,161 | A | 2/1981 | Adair et al. |

(Continued)

FOREIGN PATENT DOCUMENTS

| | | |
|---|---|---|
| GB | 746455 | 3/1956 |

*Primary Examiner*—Darnell M Jayne
*Assistant Examiner*—Timothy M Ayres
(74) *Attorney, Agent, or Firm*—Boyle Fredrickson, S.C.

(57) ABSTRACT

A desk for use in supporting a computer and/or computer-related devices includes a base adapted to rest on a support surface such as a floor, in combination with an upwardly extending support that defines a lower end interconnected with the base and an upper end spaced vertically above the lower end. A desk top member is secured to the upper end of the support. The upwardly extending support and the desk top member are configured and arranged such that the desk top member is located forwardly of the rear area of the base, and to define an open area below the desk top member between the desk top member and the base. The base can be moved on the support surface to position the desk top member over a user's lap when the user is in a seated position. The desk may include a base pivot connection between the base and the upwardly extending support, and a desk top pivot connection between the desk top and the upwardly extending support. The pivot connections enable the desk to be placed in a collapsed condition for storage. The upwardly extending support includes a height adjustment arrangement for adjusting the height of the desk top member relative to the base.

16 Claims, 22 Drawing Sheets

U.S. PATENT DOCUMENTS 5,417,168 A 5/1995 Soper
5,460,392 A 10/1995 Hansen
6,327,982 B1 12/2001 Jackson
6,349,512 B1 2/2002 Berkey et al.
6,694,891 B1 2/2004 Lai

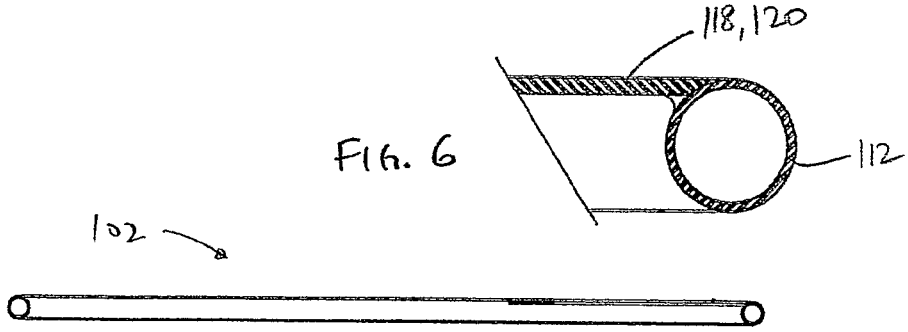
FIG. 6
FIG. 5
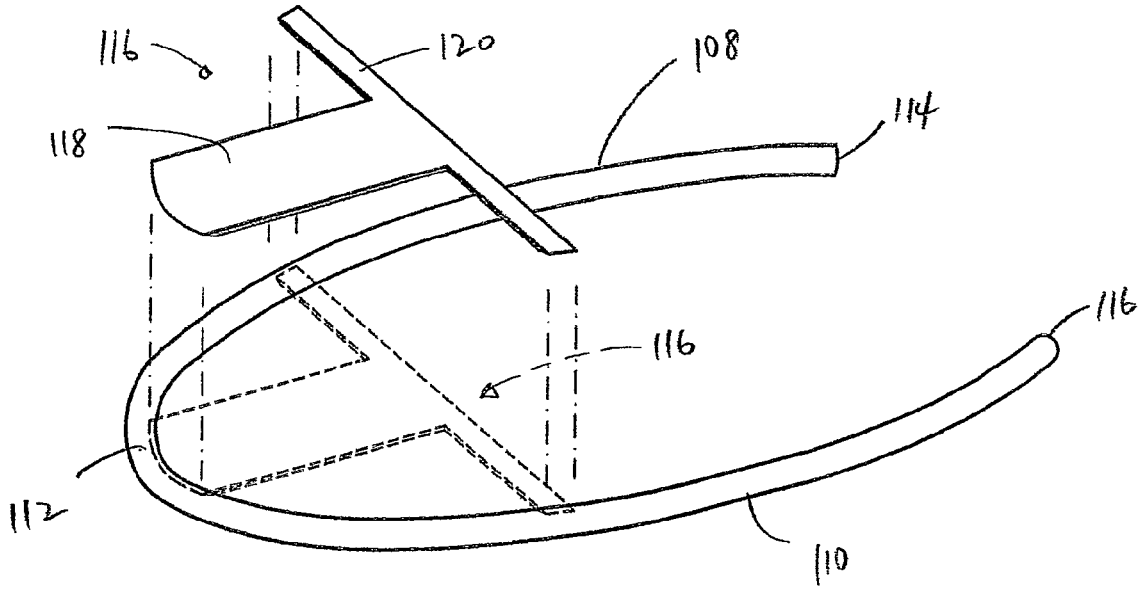
FIG. 2

COMPUTER DESK

CROSS REFERENCE TO RELATED APPLICATIONS

This application claims the benefit of U.S. provisional application Ser. No. 60/569,697 filed May 10, 2004.

BACKGROUND AND SUMMARY OF THE INVENTION

This invention relates to furniture, and more particularly to desk-type furniture that is adapted for use in supporting a computer or the like over the lap of a user when the user is in a seated position.

Due to the proliferation and advances in computers and computer-related peripheral devices, the use of computers in the home and in other casual settings is becoming increasingly prevalent. Advances in computers and related devices has resulted in equipment that is increasingly small in size, and wireless technology has eliminated the need for computers and related devices to be maintained in a single location, such as on a stationary computer desk or other article of furniture. Users are thus able to use computers and related devices ices in many different areas of a home, office or other setting, and peripherals can be accessed by multiple computers anywhere in a building that has a wireless network.

The development of computer support furniture has lagged behind the noted advancements in technology relating to computers and related devices, which has resulted in a loss of synergy between the user and technology. Prior art computer support furniture has focused on indigent or institutional users, with products offering partial solutions and clumsy designs. Further, because prior art designs have been based on a rudimentary understanding of laptop PC users, the prior art offers few functional or aesthetic solutions and accommodate laptop computers and accessories as an afterthought.

It is an object of the present invention to provide a desk-type support that is well suited for use in supporting a computer or the like over the lap of a user when the user is in a seated position, to address the synergistic conflict between the user of a computer or related device and the furniture or other support structure that is used to support the computer or related device. It is a further object of the invention to provide such a desk-type support that can be easily moved by a user to a variety of locations within a room, to accommodate different locations that are available to the user. It is a further object of the invention to provide such a desk-type support in the form of contemporary, ergonomic, light, stable, simple, flexible and tasteful furniture for a residential user desiring to use a computer or related device from a sofa or casual chair. Yet another object of the invention is to provide such a desk-type support that provide superior, adjustable ergonomic support for the computer or related device. A still further object of the invention is to provide such a desk-type support that may be permanent furniture or easily folded and stored in a closet or other storage area.

In accordance with one aspect of the present invention, a desk for use in supporting a computer and/or computer-related devices includes a base adapted to rest on a support surface such as a floor, in combination with an upwardly extending support that defines a lower end interconnected with the base and an upper end spaced vertically above the lower end, and a desk top member secured to the upper end of the upwardly extending support. The base defines a front area and a rear area, and includes a pair of horizontally oriented laterally spaced apart base members that engage the support surface and extend in a front-rear direction. The base members are interconnected with each other toward the rear area of the base, and the lower end of the upwardly extending support is interconnected with the base at the rear area of the base. The upwardly extending support and the desk top member are configured and arranged such that the desk top member is located forwardly of the rear area of the base and the area below the desk top member between the desk top member and the base is open. With this arrangement, the base can be moved on the support surface to position the desk top member over a user's lap when the user is in a seat position. The desk may include a base pivot connection between the base and the upwardly extending support and a desk top pivot connection between the desk top and the upwardly extending support. The pivot connections enable the desk to be placed in a collapsed condition for storage.

A height adjustment arrangement is associated with the upwardly extending support for adjusting the height of the desk top member relative to the base. In one embodiment, the base, the upwardly extending support and the desk top member are separate components. The lower end of the upwardly extending support is interconnected with the base via a base connection and the desk top member is secured to the upper end of the upwardly extending support via a desk top connection. The height adjustment arrangement is incorporated in one of the base connection and the desk top connection. The height adjustment arrangement may be in the form of a telescoping connection at either the base connection or the desk top connection, and the telescoping connection may include a mounting member that extends from one of the base and the desk top, and a variable position engagement arrangement between the mounting member and the adjacent end of the upwardly extending support. A space is defined between either the base or the desk top and the adjacent end of the upwardly extending support when the vertical position of the desk top is adjusted upwardly relative to the base via the variable position engagement arrangement, and a spacer is configured for engagement within the space. The spacer may have a cross section that matches the cross section of the upwardly extending support, and may include a recess within which the mounting member is received.

In one embodiment, the base is configured such that the pair of base members are generally parallel to each other, and the rear area of the base includes a transversely extending rear member that extends between and interconnects the base members at the rear area of the base. The pair of base members and the rear member are oriented in a horizontal plane, and the upwardly extending support is in the form of a pair of vertical support members, each of which extends upwardly from a corner defined at a connection between the rear member and one of the base members. The desk top is secured to a desk top support that extends forwardly from an upper end defined by each of the pair of vertical support members.

In another embodiment, the pair of horizontally oriented laterally spaced apart base members are in the form of a pair of arcuate base members that are interconnected together at the rear area of the base. Each of the arcuate base members extends laterally outwardly and forwardly from the rear area of the base. The base further includes a T-shaped rear member having an axial member and a transverse member. The transverse member defines a pair of ends, each of which is secured to one of the arcuate base members, and the axial member of the T-shaped rear member is connected at a rear connection area defined between the pair of arcuate base members. The upwardly extending support may be in the form of a central cantilevered member defining a lower rear end secured to the rear area of the base and an upper forward end to which the desk top member is mounted. The height adjustment arrangement is associated with the central cantilevered member for adjusting the height of the desk top member relative to the base.

The invention also contemplates a method of positioning a worksurface above a supporting surface such as a floor, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 2 is an exploded isometric view of a base incorporated in the desk-type support of FIG. 1;

FIG. 5 is a side elevation view of the base of FIG. 2;

FIG. 6 is a section view taken along lines 6-6 of FIG. 3;

DETAILED DESCRIPTION OF THE INVENTION

Figure 1:
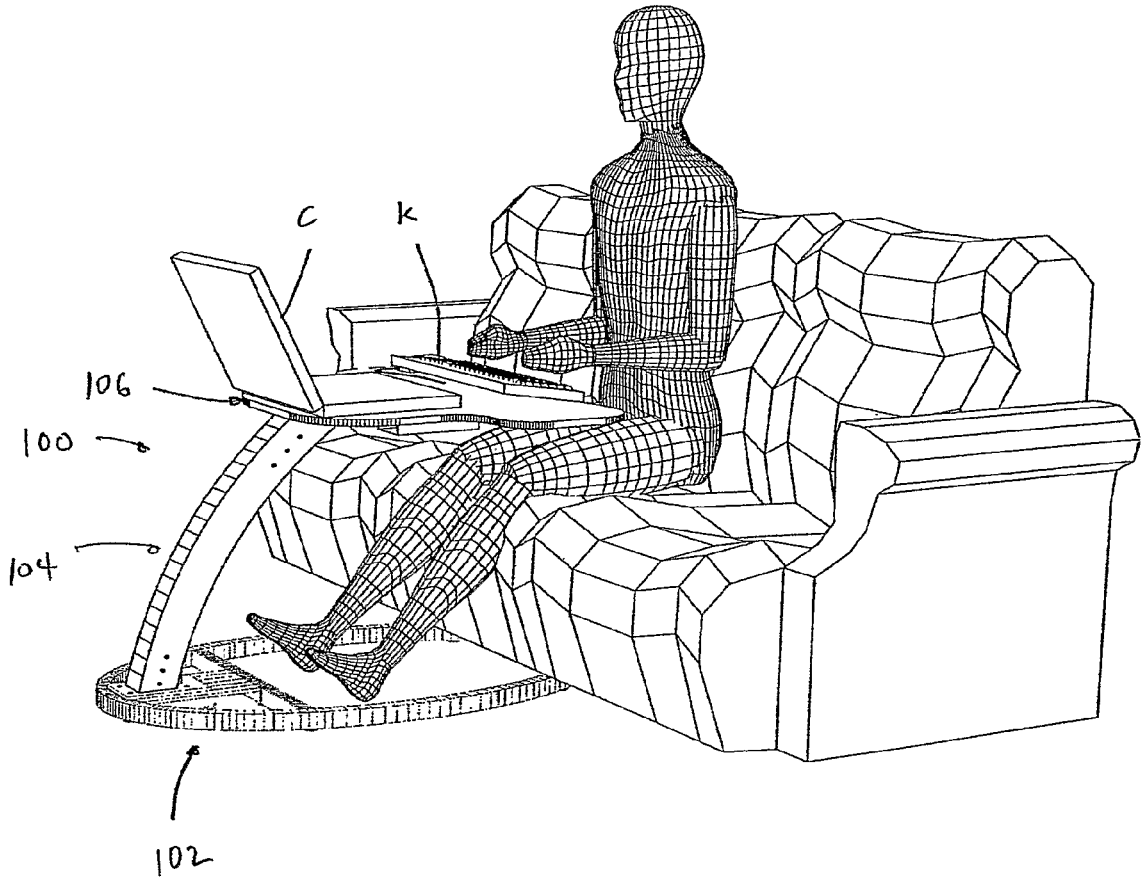
FIG. 1 is an isometric view showing a representative embodiment of a desk-type support of the present invention for supporting a computer or a computer-related device over the lap of a user in a seated position.
Figure 3:
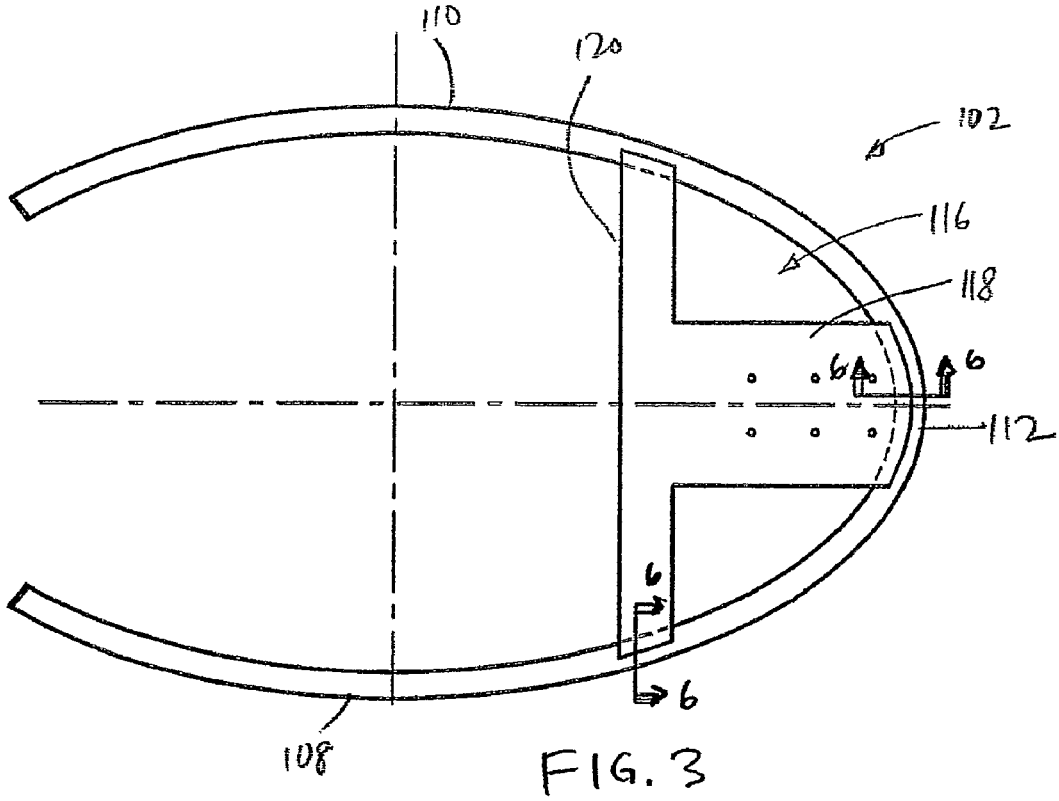
FIG. 3 is a top plan view of the base of FIG. 2.
Figure 4:
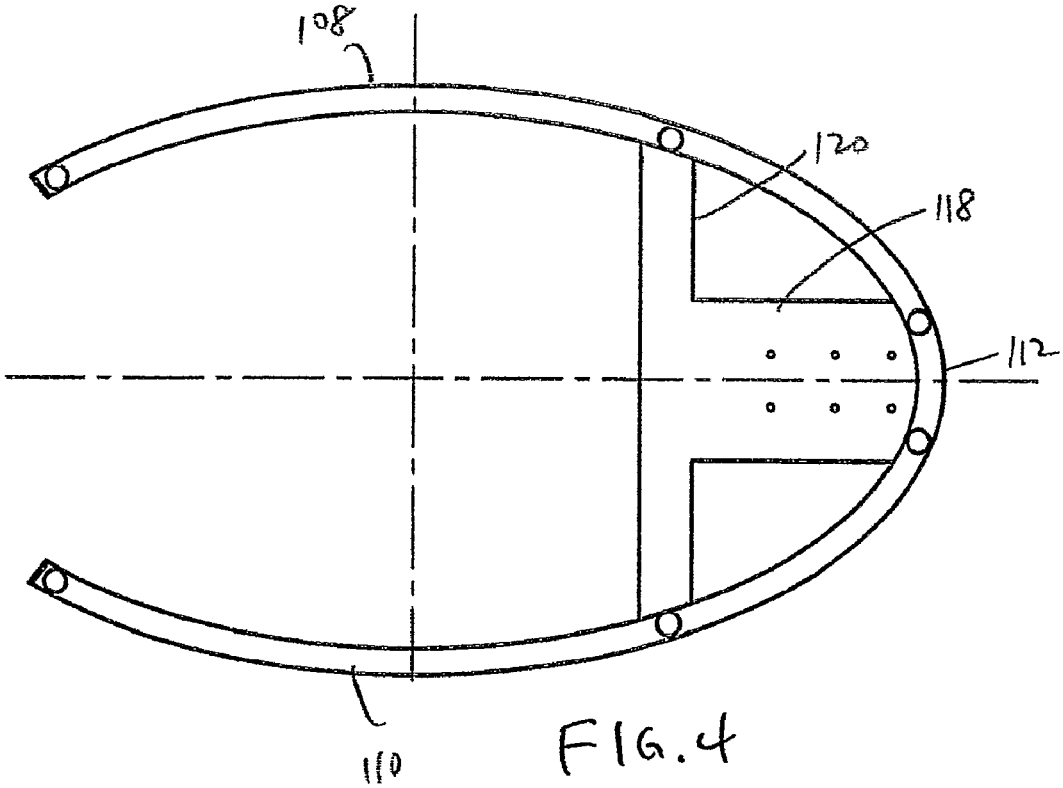
FIG. 4 is a bottom plan view of the base of FIG. 2.

FIG. 1 illustrates a desk-type support 100 in accordance with the present invention, which is especially adapted for use in an informal environment for use in supporting computer equipment over the lap of a user in a seated position. In FIG. 1, the user is shown seated on a sofa, which is but one example of an article of furniture in connection with which the support 100 of the present invention may be employed. Support 100 is especially well suited for use in a casual environment for enabling a user to perform computer-related tasks when seated. Typically, the equipment supported on the support 100 is wireless, which enables the area in the vicinity of the support 100 to be clear of wires or cables. However, it is also understood that support 100 may be used to support computers or related devices that have wire or cable connections.

Generally, support 100 includes a base 102 that rests on a support surface such as a floor, a cantilevered, upwardly extending support member 104 that is connected at a lower end to base 102, and a desk top support member 106 that is secured to the upper end of support member 104. As shown in FIG. 1, base 102 has a low profile, which enables base 102 to be moved under the sofa or other article of furniture on which the user is seated, so as to enable desk top member 106 to be moved inwardly and outwardly relative to the user's body.

FIGS. 2-6 illustrate the construction of base 102. Generally, base 102 includes a pair of base members 108, 110, that extend in a front-rear direction from a rear end area 112. In the illustrated embodiment, base members 108, 110 and rear end area 112 are formed integrally of a bent, formed or otherwise shaped length of tubing or other satisfactory material. Base members 108, 110 terminate in respective forward ends 114, 116. Base 102 further includes a T-shaped rear bracket 116, which has an axial section 118 and a transverse section 120. Rear bracket 116 is formed such that the end of axial section 118 has a curvature that matches that of rear end area 112 of base 102. The ends of transverse section 120 are in engagement with base members 108, 110. As shown in FIG. 6, the end of rear bracket axial section 118 and the ends of transverse section 120 may be secured to base 102 in any satisfactory manner, such as by a weld connection. With this construction, base 102 lies in a horizontal plane, and provides a significant degree of stability in a front-rear direction.

Figure 8:
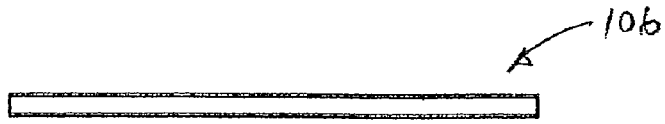
FIG. 8 is a side elevation view of the desk top member of FIG. 7.
Figure 7:
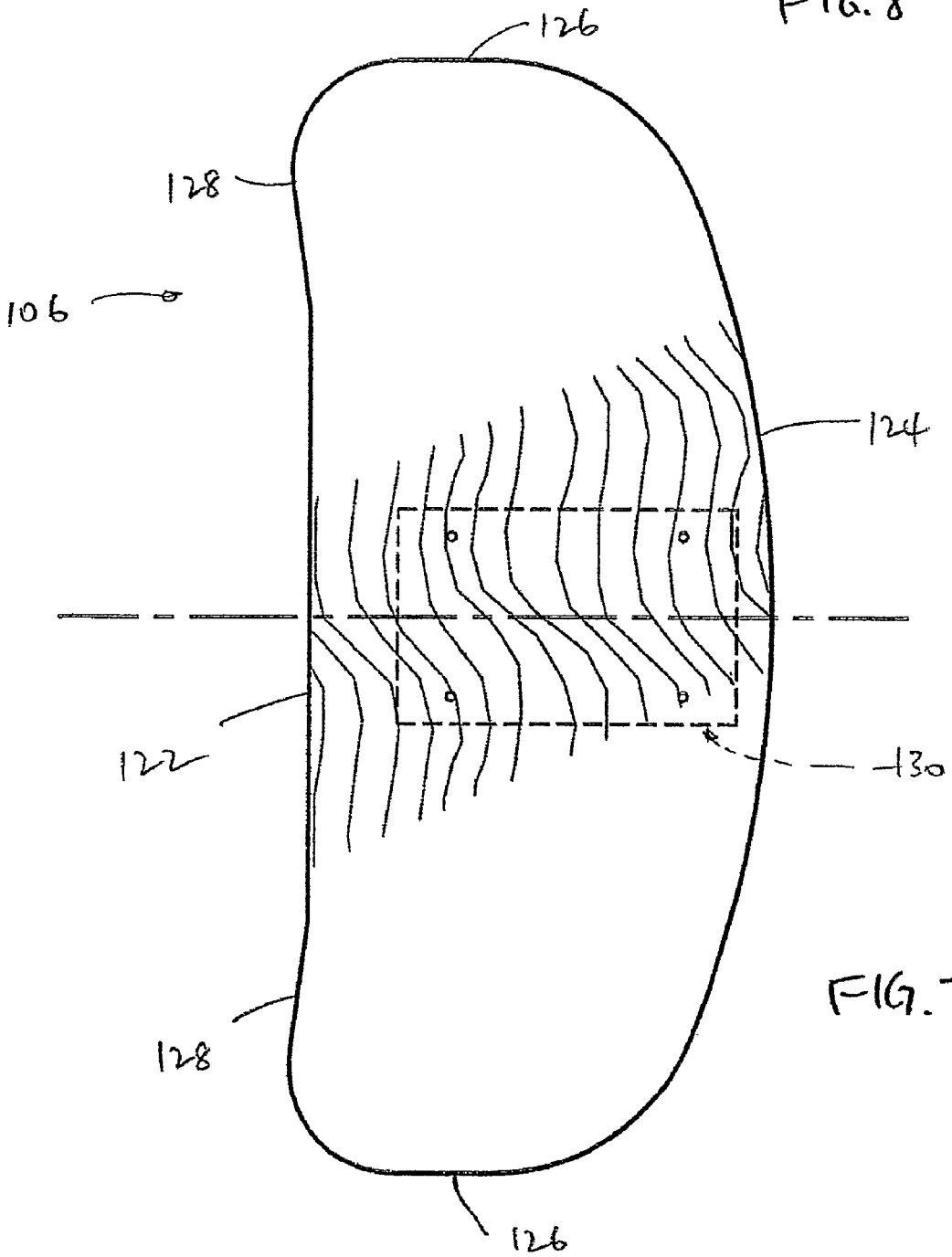
FIG. 7 is a top plan view of one embodiment of a desk top member that can be incorporated into the desk-type support of FIG. 1.
Figure 14:
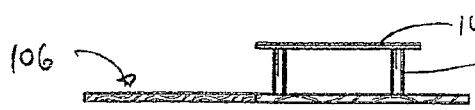
FIG. 14 is a side elevation view of the desk top member of FIG. 11.
Figure 13:
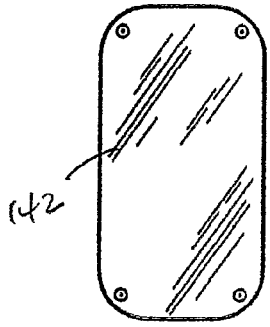
FIG. 13 is a plan view of the platform incorporated in the desk top member of FIGS. 11 and 12.

FIGS. 7 and 8 illustrate one embodiment of a desk top member 106 that can be incorporated in desk-type support 100. This embodiment of desk top member 106 is a simple planar member having a transverse rear edge 122 and a convex front edge 124, which are connected together by side edges 126. Rear edge 122 includes angled end areas 128, which provide additional surface area at the user's sides. A desk top mounting member, shown in phantom at 130, is employed to mount desk top member 106 to support member 104.

Figure 9:
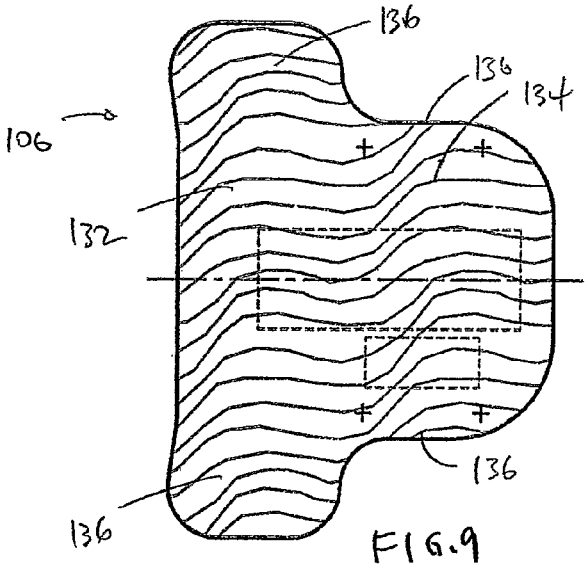
FIG. 9 is a top plan view of an alternative embodiment of a desk top member that can be incorporated into the desk-type support of FIG. 1.
Figure 10:
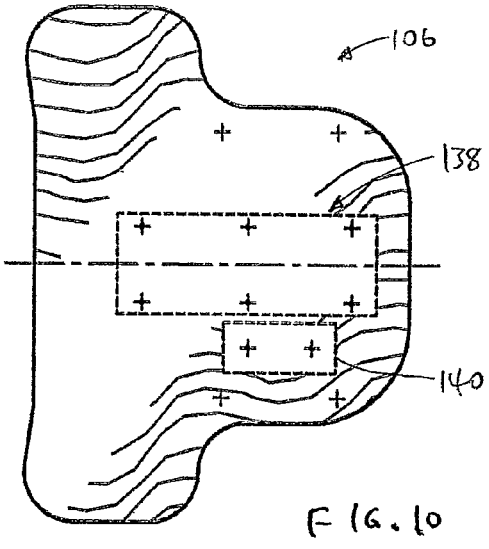
FIG. 10 is a bottom plan view of the desk top member of FIG. 9.

FIGS. 9 and 10 illustrate an alternative desk top member 106 that may be incorporated in desk-type support 100. In this embodiment, desk top member 106 again is a planar member that includes a front area 132 and a rear area 134 that extends from front area 132. Front area 132 includes side areas 134 that are located outwardly of side edges of rear area 134, shown at 136, such that rear area 134 has a lesser width than front area 132. A desk top mounting member 138 is adapted for securement to the underside of desk top member 106, for use in securing desk top member 106 to support member 104. An optional cord holder 140 may also be secured to the underside of desk top member 106, for maintaining cords, cables or wires out of the open area below desk top member 106.

The desk top member 106 may be formed of any satisfactory material, such as metal, wood, furniture grade plywood, etc.

Figure 11:
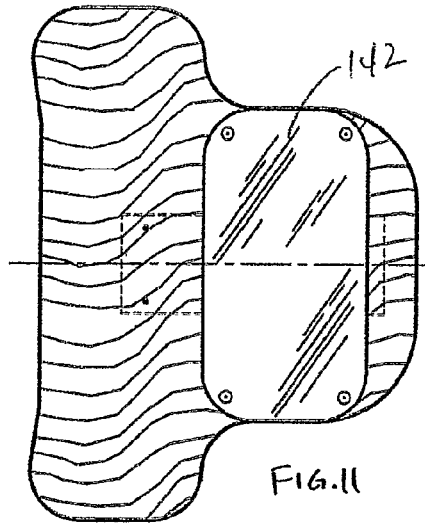
FIG. 11 is a top plan view of another embodiment of a desk top member that can be incorporated into the desk-type support of FIG. 1, which includes a platform that overlies a portion of the desk top member.
Figure 12:
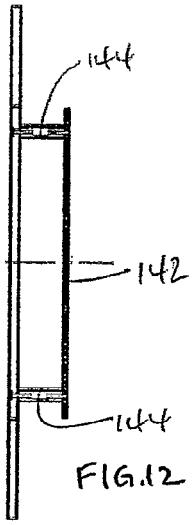
FIG. 12 is a front elevation view of the desk top member of FIG. 11.

FIG. 11 illustrates desk top member 106 as in FIGS. 9 and 10, in combination with a platform 142 that is mounted over a portion of rear area 134, for supporting a computer or related device at an elevation above desk top member 106. Platform 142 may be spaced above the upper surface of desk top member 106 using a series of platform spacers 144 at the corners of platform 142. With this arrangement, the area below platform 142 may also be employed to receive computer devices or related equipment, to provide two-tiered support. Platform 142 may be formed of any satisfactory material, such as a metallic material (e.g. aluminum), wood, plastic or glass.

Figure 15A:
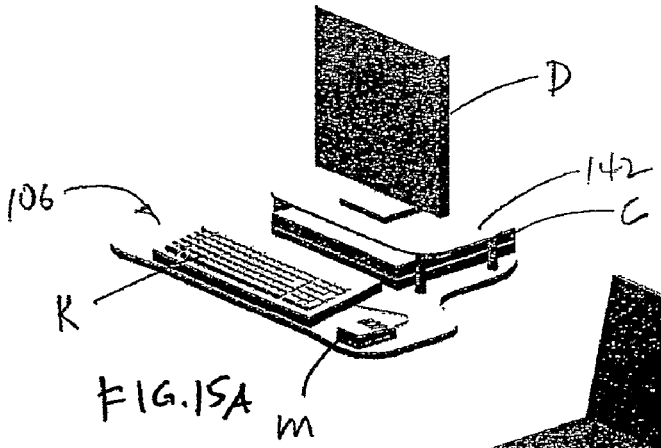
FIGS. 15A-15F are isometric views that illustrate the desk top members of FIGS. 7, 9 and 11, showing the manner in which the desk top member supports a computer or computer-related equipment.
Figure 15B:
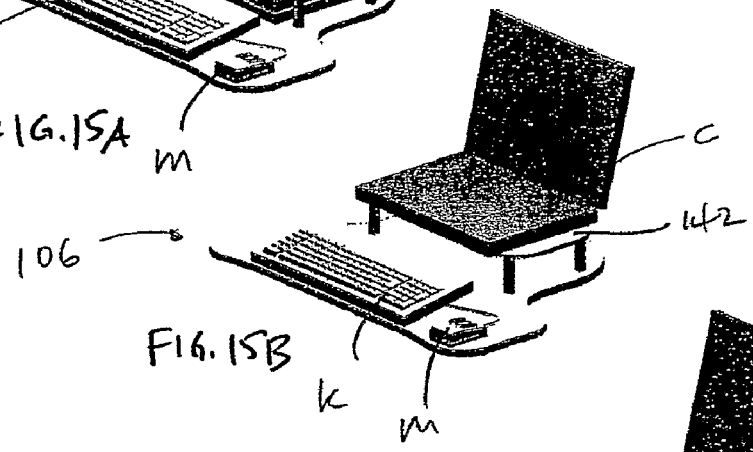
Figure 15C:
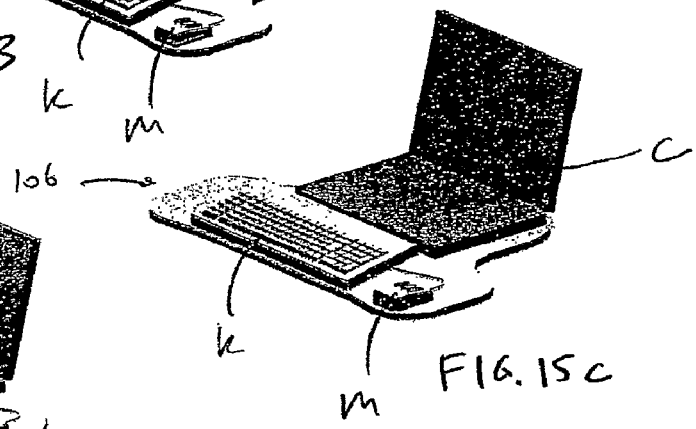
Figure 15D:
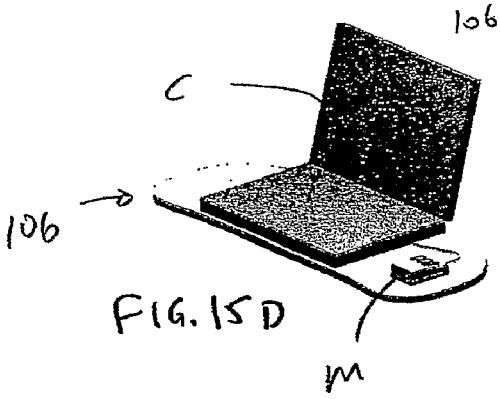
Figure 15E:
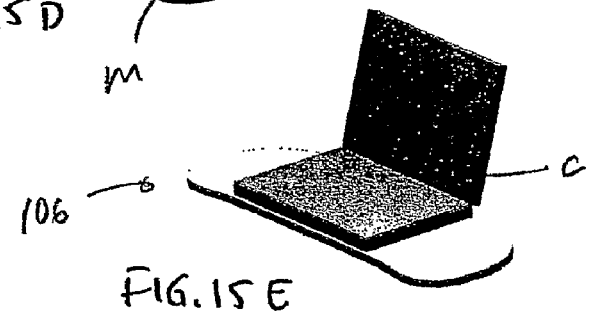
Figure 15F:
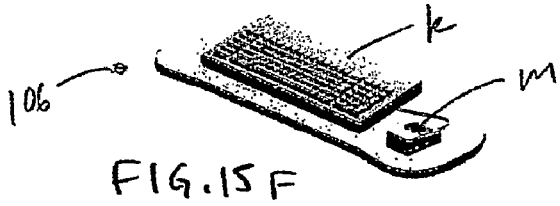
Figure 18:
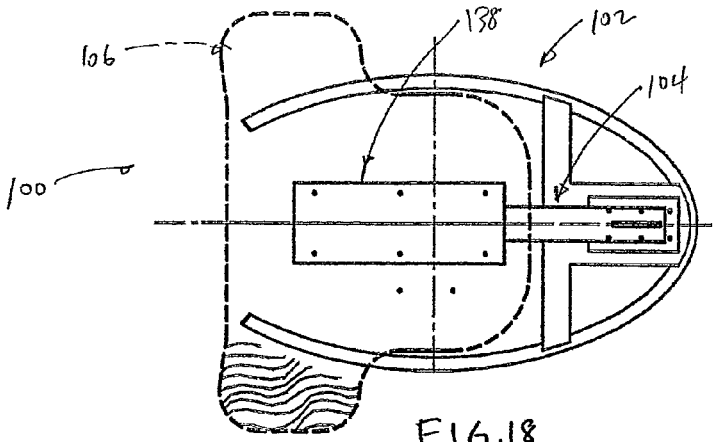
FIG. 18 is a top plan view of the desk-type support of FIGS. 1, 16 and 17.
Figure 17:
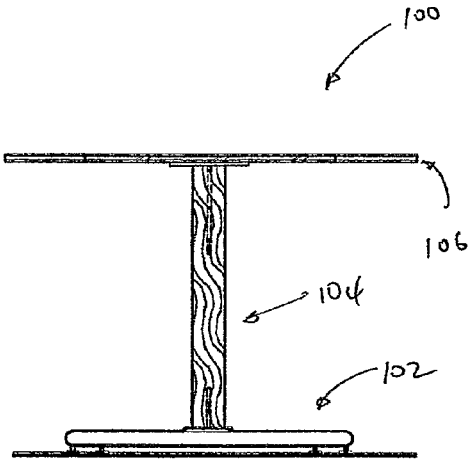
FIG. 17 is an end elevation view of the desk-type support of FIGS. 1 and 16.
Figure 16:
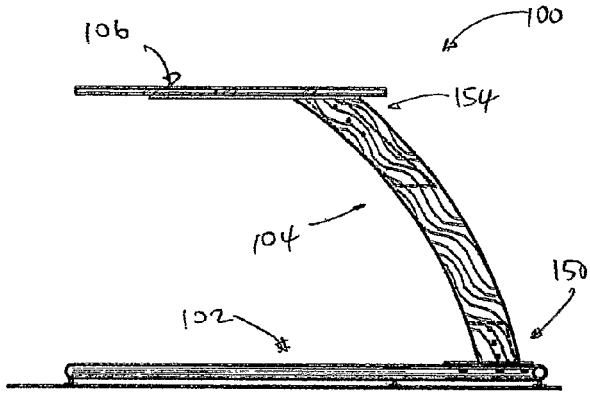
FIG. 16 is a side elevation view of the desk-type support of FIG. 1.
Figure 19:
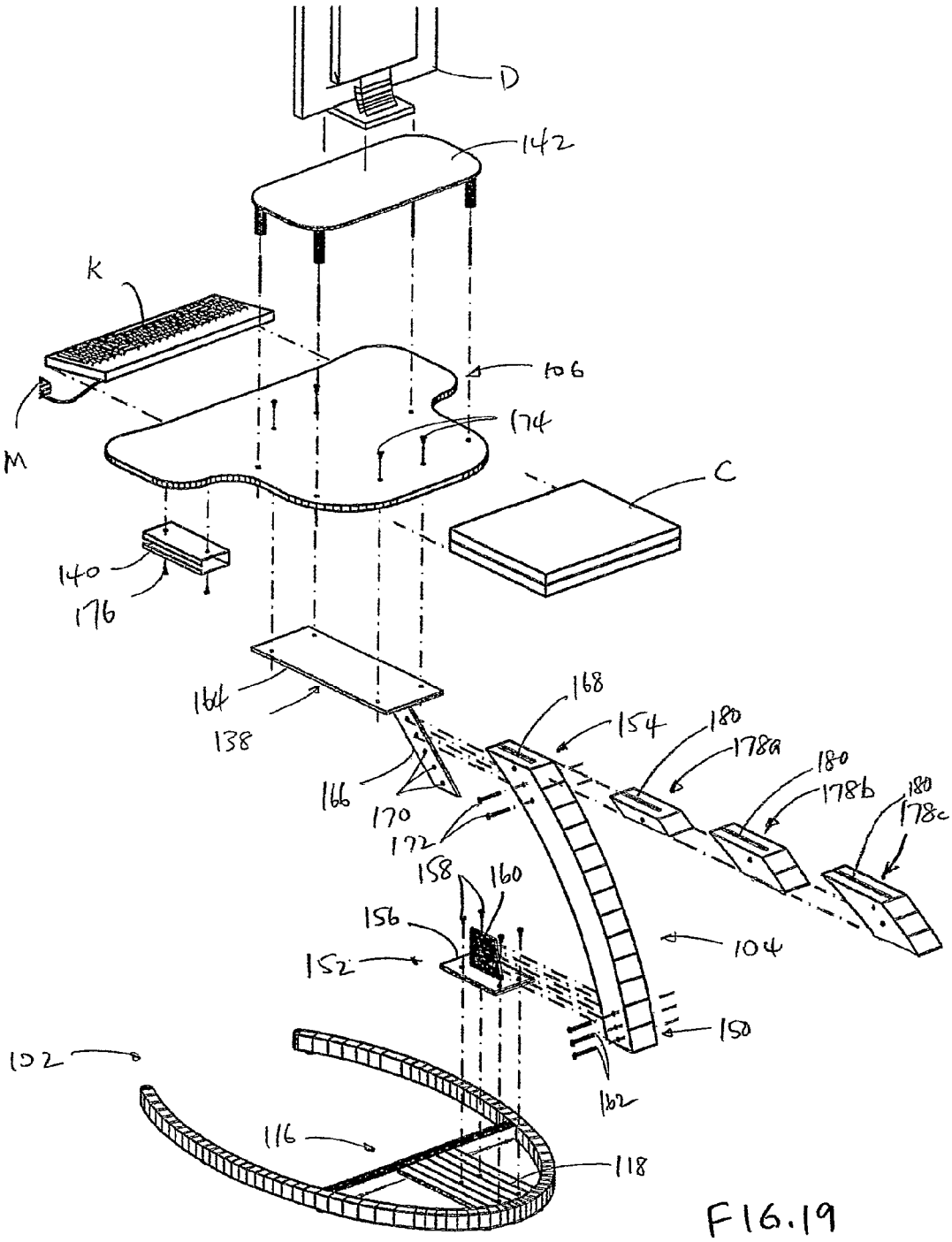
FIG. 19 is an exploded isometric view of the desk-type support of FIGS. 1 and 16-18.
Figures 20, 21, 22, 23, 24, 25, 26, 27, 28:
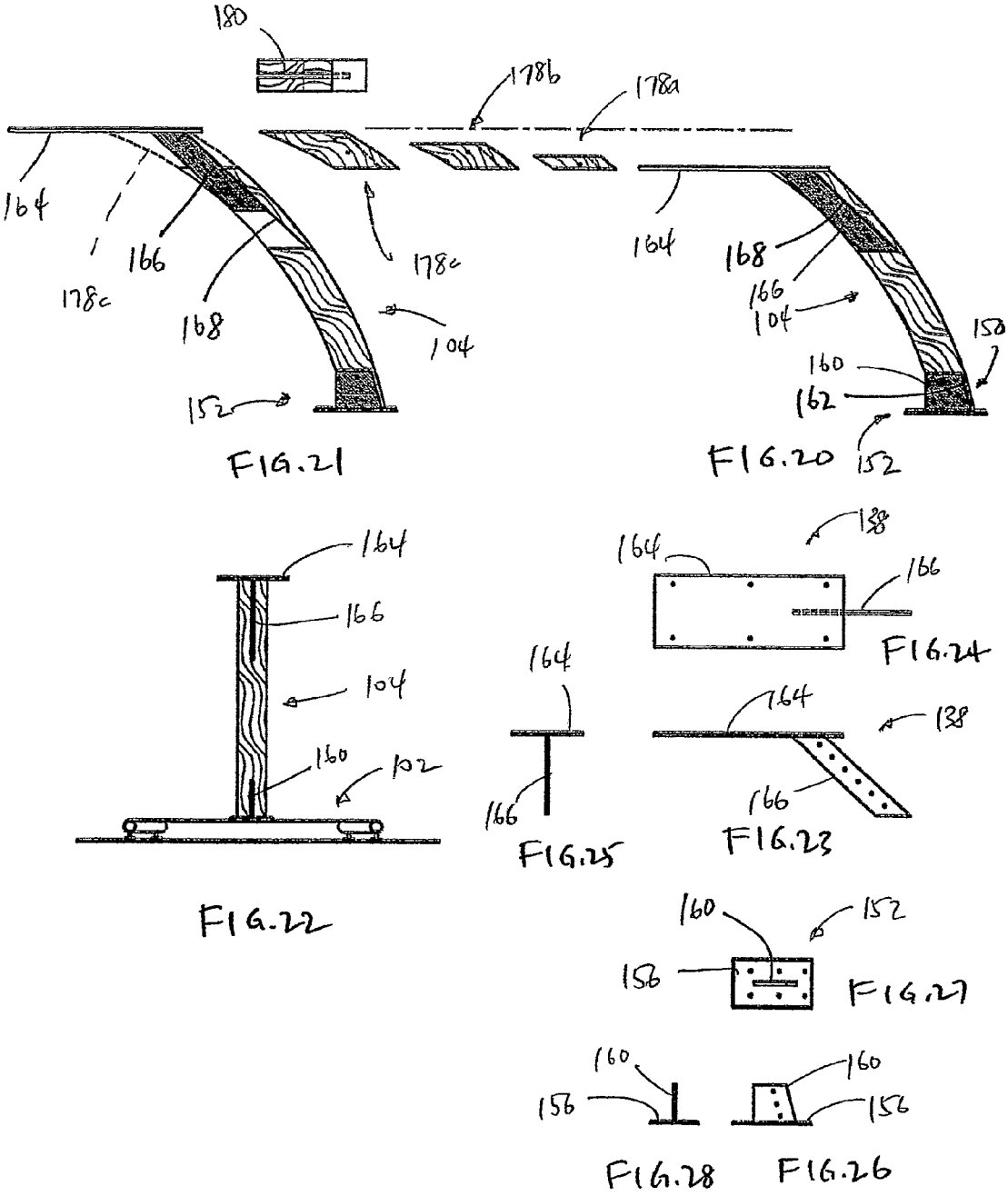
FIG. 20 is a side elevation view, with portions broken away, showing a central support member incorporated in the desk-type support of FIGS. 1 and 16-19, and a height adjustment arrangement for use therewith.
FIG. 21 is a view similar to FIG. 20, showing adjustment in the height of the central support member.
FIG. 22 is an end elevation view of the support member of FIG. 20.
FIG. 23 is a side elevation view of an adjustable height desk top mounting member incorporated in the support member of FIG. 20.
FIG. 24 is a top plan view of the desk top mounting member of FIG. 23.
FIG. 25 is an end elevation view of the desk top mounting member of FIGS. 23 and 24.
FIG. 26 is a side elevation view of a base mounting member incorporated in the support member of FIG. 20.
FIG. 27 is a top plan view of the base mounting member of FIG. 26.
FIG. 28 is an end elevation view of the base mounting member of FIG. 26.
Figure 31:
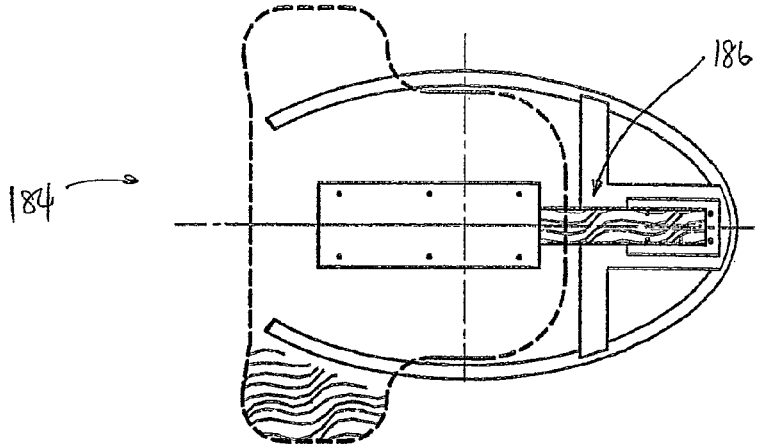
FIG. 31 is a top plan view of the desk-type support of FIGS. 29 and 30.
Figure 30:
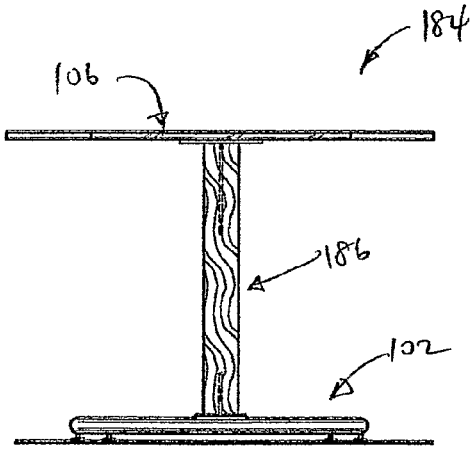
FIG. 30 is an end elevation view of the desk-type support of FIG. 29.
Figure 29:
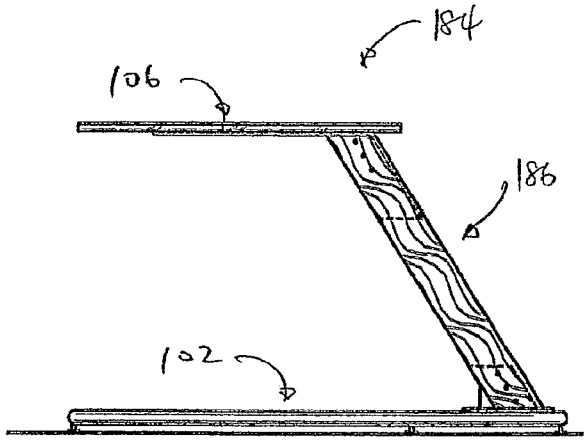
FIG. 29 is a side elevation view of another embodiment of a desk-type support in accordance with the present invention.
Figure 32:
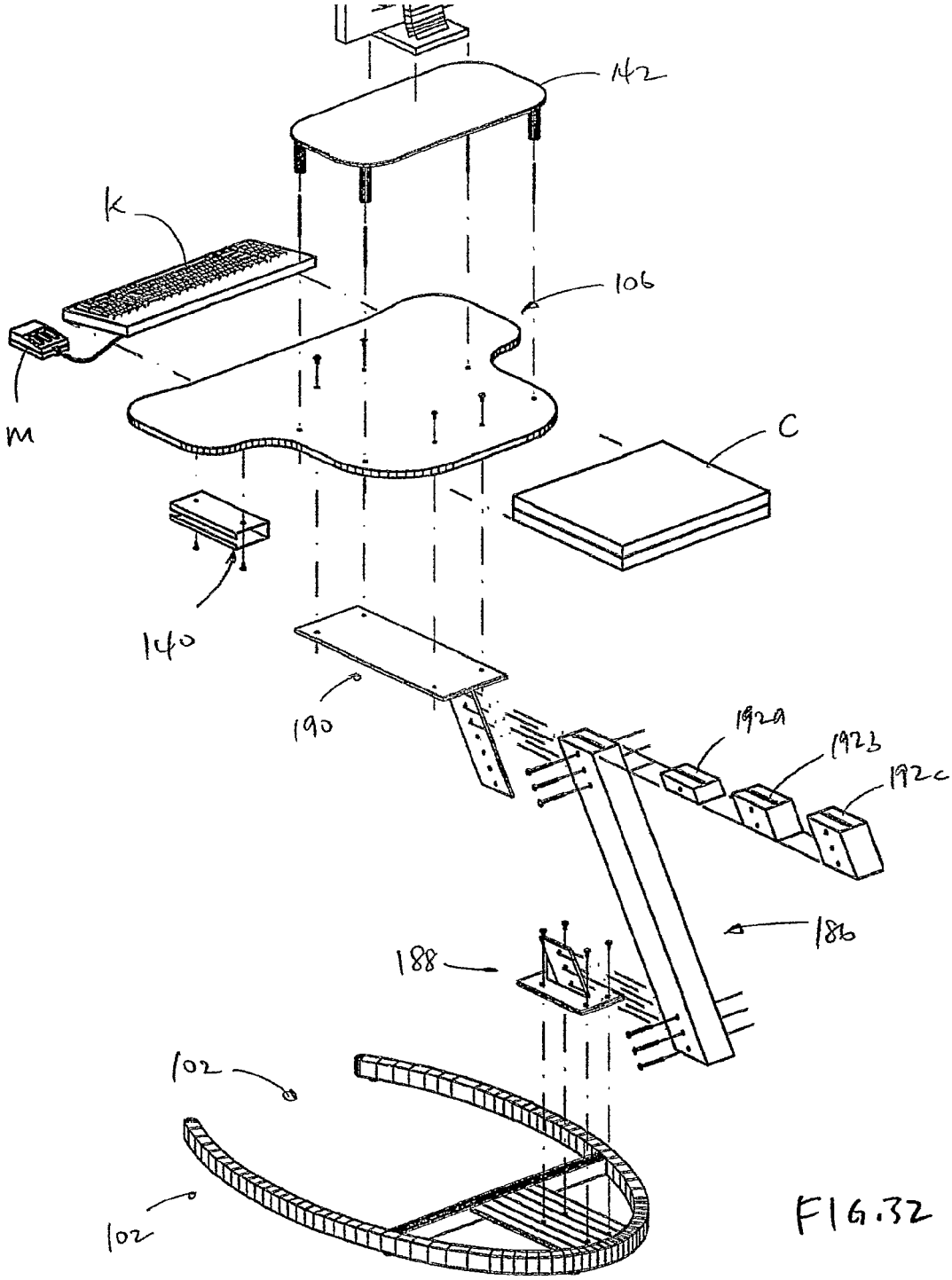
FIG. 32 is an exploded isometric view of the desk-type support of FIGS. 29-31.
Figure 34:
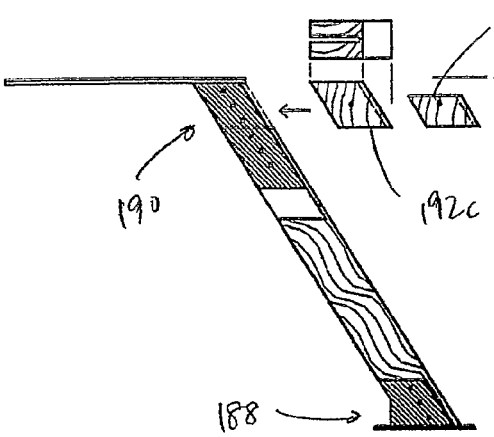
FIG. 34 is a view similar to FIG. 33, showing adjustment in the height of the central support member.
Figure 33:
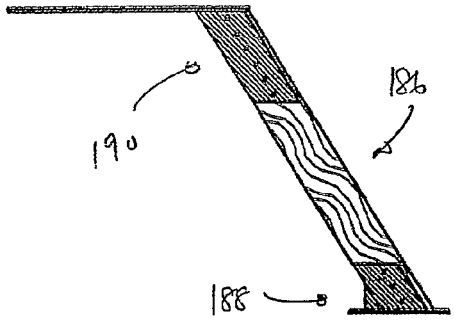
FIG. 33 is a side elevation view, with portions broken away, showing a central support member incorporated in the desk-type support of FIGS. 29-31 and a height adjustment arrangement for use therewith.
Figure 35:
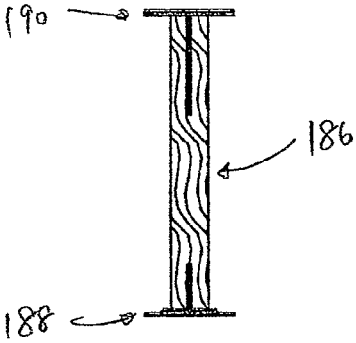
FIG. 35 is an end elevation view of the central support member of FIGS. 33 and 34.
Figure 37:
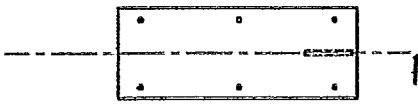
FIG. 37 is a top plan view of the desk top mounting member of FIG. 36.
Figure 38:
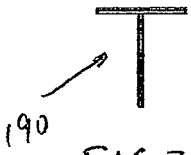
FIG. 38 is an end elevation view of the desk top mounting member of FIGS. 37 and 38.
Figure 36:
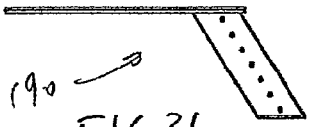
FIG. 36 is a side elevation view of an adjustable height desk top mounting member incorporated in the central support member of FIG. 33.
Figure 40:
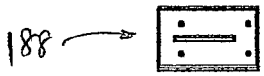
FIG. 40 is a top plan view of the base mounting member of FIG. 39.
Figure 41:
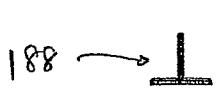
FIG. 41 is an end elevation view of the base mounting member of FIG. 39.
Figure 39:
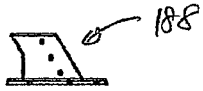
FIG. 39 is a side elevation view of a base mounting member incorporated in the support member of FIG. 33.
Figure 44:
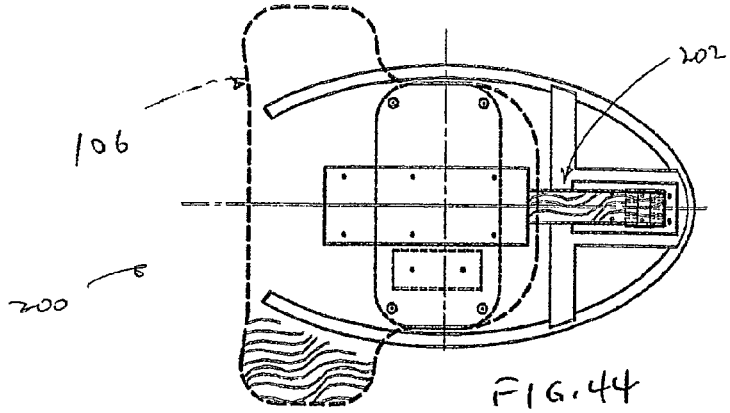
FIG. 44 is a top plan view of the desk-type support of FIGS. 42 and 43.
Figure 43:
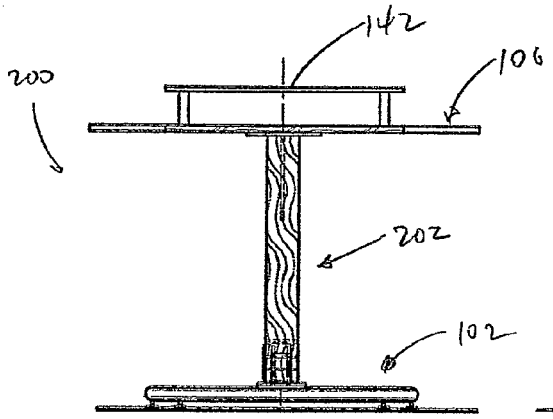
FIG. 43 is an end elevation view of the desk-type support of FIG. 42.

FIG. 15A shows desk top member 106 as in FIGS. 10-14, in combination with platform 142 as in FIGS. 11-14. In this arrangement, a computer keyboard K and mouse M may be supported by the area of desk top member 106 forwardly of platform 142. A laptop or notebook computer C may be folded and stored in the space between rear area 134 of desk top 106 and platform 142. A flat screen monitor or other display D may be placed on platform 142. FIG. 15B shows an arrangement in which the same desk top support 106 and platform 142 may be used to support keyboard K and mouse M as in FIG. 15*a*, with laptop or notebook computer C being placed on platform 142 in an open position so as to enable the screen of computer C to be viewed by the user. FIG. 15C illustrates an embodiment in which desk top member 106 as in FIGS. 9 and 10 is used without platform 142. In this arrangement, keyboard K and mouse M are supported on front area 132 of desk top member 106, and laptop or notebook computer C is supported on rear area 132. The screen of computer C is open so as to be visible by the user. FIG. 15E shows desk top member 106 as in FIGS. 7 and 8, supporting an open computer C and an adjacent mouse M. FIG. 15E illustrates desk top member 106 with open computer C without mouse M. FIG. 15F shows desk top member 106 supporting keyboard K and mouse M, which may be employed when keyboard K and mouse M wirelessly communicate with a computing device, which may be a television screen or other display at a location remote from desk-type support 100.

FIGS. 16-19 show details of the construction of desk-type support 100, which includes desk top member 106 as shown in FIGS. 9 and 10. It is understood, however, that desk top member 106 may also be as shown in FIGS. 7 and 8 or as shown in FIGS. 11-14. It is also understood that desk top member 106 may have any other satisfactory shape or configuration.

Support member 104 defines a lower end 150 that is mounted to base 102 via a base mounting member 152, and an upper end 154 to which desk top member 106 is secured via desk top mounting member 138. Base mounting member 152 includes a base plate 156 that is adapted for securement to axial section 118 of rear bracket 1 16 in any satisfactory manner, such as via threaded fasteners 158. A mounting plate 160 extends upwardly from base plate 156, and includes a series of vertically spaced openings. Lower end 150 of support member 104 includes a downwardly and forwardly open vertical slot 162, within which mounting plate 160 is received. In this manner, the lower end 150 of support member 104 rests on the upwardly facing surface of base plate 156. Lower end 150 is secured to mounting plate 160 in any satisfactory manner, such as by fasteners 162 that extend through transverse passages in lower end 150 into engagement with the openings in mounting plate 160, or into engagement with threaded receivers on the opposite side of support member 104.

In a similar manner, desk top mounting member 138 includes a desk top plate 164 that is adapted for engagement with the underside of desk top member 106, and a downwardly and rearwardly extending mounting plate 166. The upper end of support member 104 includes an upwardly and forwardly open slot 168, which is configured to receive desk top mounting plate 166. Desk top mounting plate 166 and desk top plate 164 define an obtuse angle, and the curvature of support member 104 is such that slot 168 can extend in a linear orientation into the upper end area of support member 104. Desk top mounting plate 166 defines a series of aligned openings 170. Upper end 154 of support member 104 includes transverse passages that receive suitable connectors, such as fasteners 172, which are engaged with selected ones of openings 170 to fix desk top mounting member 138 to the upper end of support member 104. Desk top member 106 may be secured to desk top plate 164 in any satisfactory manner, such as via fasteners 174 that extend through openings in desk top member 106 or into engagement with aligned openings in desk top plate 164. Cord holder 140 is secured to the underside of desk top member 106 in any satisfactory manner, such as via fasteners 176 that extend through openings in the upper wall of cord holder 140 into aligned openings in the underside of desk top member 106.

The elevation of desk top member 106 above base 102 can be adjusted by moving desk top mounting plate 166 within slot 168 until desk top member 106 is at the desired elevation. The user then engages fasteners 172 through the transverse passages in upper end 154 of support member 104, into engagement with the aligned set of openings 170. In this manner, the elevation of desk top member 106 can be selectively adjusted to incremental heights that correspond to the spacing between openings 170.

When desk top member 106 is positioned above the horizontal surface defined by upper end 154 of support member 104, one of a series of spacers 178*a*, 178*b* or 178*c* is positioned within the space between the horizontal upper surface of upper end 154 and the facing lower surface of desk top plate 160. Spacers 178*a*, 178*b* and 178*c* have incrementally increasing height, so that spacer 178*a* is employed when desk top member 106 is at a first raised elevation, spacer 178*b* is used when desk top member 106 is at a second raised elevation greater than the first elevation, and spacer 178*c* is used when desk top member 106 is raised to a third elevation greater than both the first and second elevations. Each of spacers 178*a-c* includes a forwardly open slot, such as 180, that extends between a horizontal lower surface and a horizontal upper surface defined by the spacer. The horizontal lower surface of the spacer rests on and engages the horizontal upper surface of base member upper end 154, and the horizontal upper spacer surface underlies and engages the underside of desk top plate 164. Spacers 178*a-c* have a cross section that matches that of support member 104, and are adapted for engagement within the space by application of a forward push-on motion, which positions desk top mounting plate 166 within the spacer slot, such as 180. In this manner, the height of desk top member 106 can be adjusted as desired, and the selected spacer 178*a*-178*c* provides the dual function of stabilizing desk top member 106 against the upper end 1564 of support member 104, and providing a finished external appearance to the upper end of support member 104.

FIGS. 29-41 illustrate a desk-type support 184 that is constructed similarly to desk-type support 100. This embodiment utilizes base 102, desk top member 106, platform 142 and cord holder 140 in the same manner as noted in connection with support 100. In this embodiment, support member 182 provides the same function as described previously with respect to support member 104, for positioning desk top member 106 above base 102. Support member 186 has a straight, linear configuration as opposed to the curved configuration of support member 104. In all other respects, however, the manner of assembly of support 184 and height adjustment is the same as noted with respect to support 100, which includes a base mounting member 188 (which function similarly to base mounting member 152), a desk top mounting member 190 (which functions similarly to desk top mounting member 138), and spacers 192*a-c* (which function similarly to spacers 178*a-c*). Support member 186 includes a downwardly and forwardly open slot in its lower end for receiving the vertical mounting plate of base mounting member 188, and the upper end of support member 186 includes an upwardly and forwardly open slot for receiving the desk top mounting plate of desk top mounting member 190, as shown and described previously.

FIGS. 44-58 illustrate a foldable desk-type support 200, which includes base 102 as described above and any of desk top members 106. In the illustrated embodiment, support 200 is shown as having a desk top member 106 that includes platform 142, although it is understood that any other satisfactory desk top member may be employed. Support 200 includes a cantilevered upwardly extending support member 202 defining a lower end 204 connected to the rear area of base 102 via a lower pivot connection shown generally at 206, and an upper, forward end 208 that is connected to desk top member 106 via an upper pivot connection 210.

Figure 46:
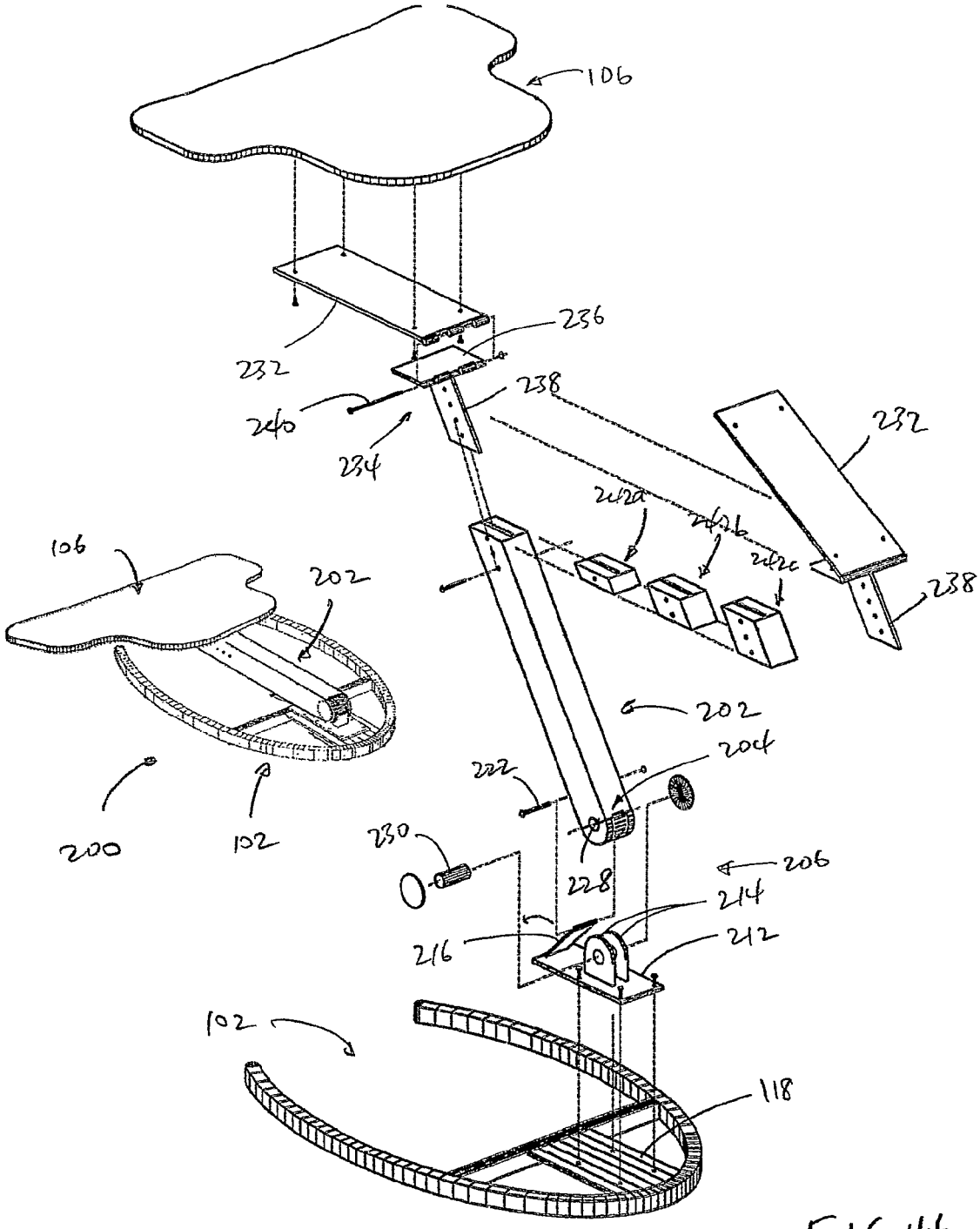
FIG. 46 is an exploded isometric view of the desk-type support of FIGS. 42-44.
Figure 48:
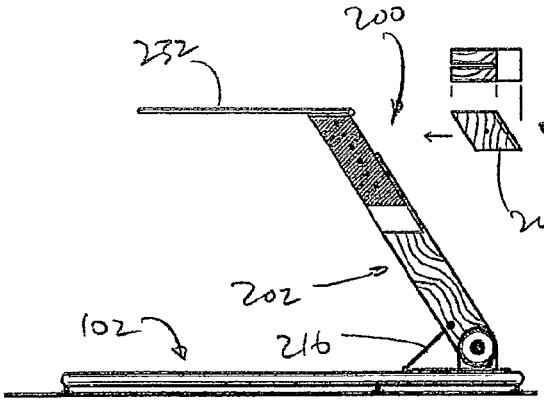
FIG. 48 is a view similar to FIG. 47, showing adjustment in the height of the central support member.
Figure 47:
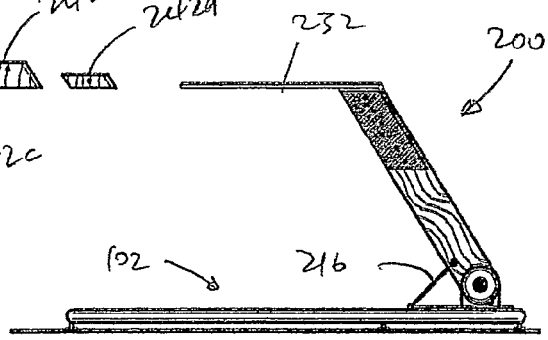
FIG. 47 is a side elevation view, with portions broken away, showing a central support member incorporated in the desk-type support of FIGS. 42-44 and a height adjustment arrangement for use therewith.
Figure 50:
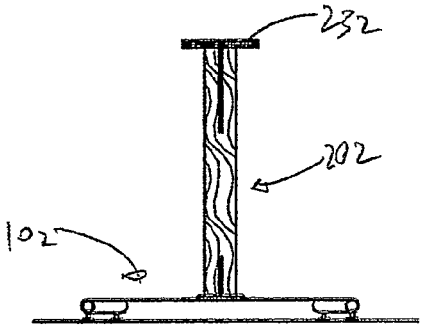
FIG. 50 is an end elevation view of the desk-type support of FIG. 47.
Figure 49:
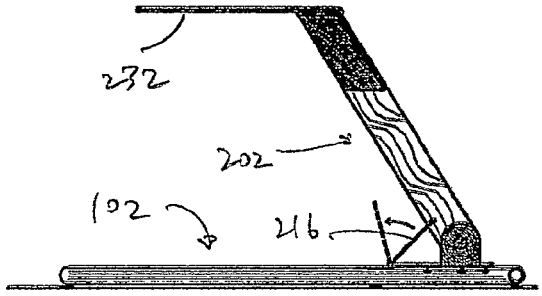
FIG. 49 is a view similar to FIG. 47, showing pivoting movement of a brace member for enabling the desk-type support to be folded as shown in FIGS. 45A-45C.
Figure 52:
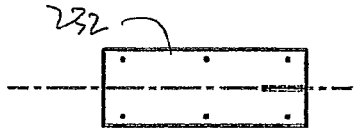
FIG. 52 is a top plan view of the desk top mounting member of FIG. 51.
Figure 53:
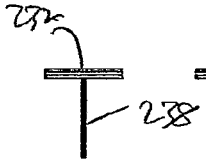
FIG. 53 is an end elevation view of the desk top mounting member of FIG. 51.
Figure 51:
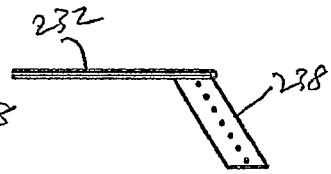
FIG. 51 is a side elevation view of an adjustable height desk top mounting member incorporated in the central support member of FIG. 47.
Figure 58:
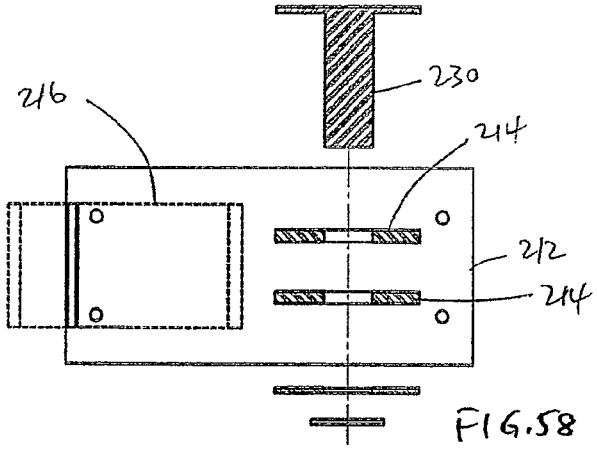
FIG. 58 is an exploded section view of the pivot connection components as illustrated in FIG. 56.
Figure 57:
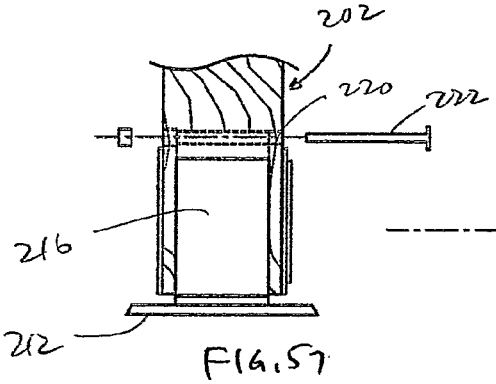
FIG. 57 is a partial end elevation view of the pivot connection shown in FIGS. 55-56.
Figure 56:
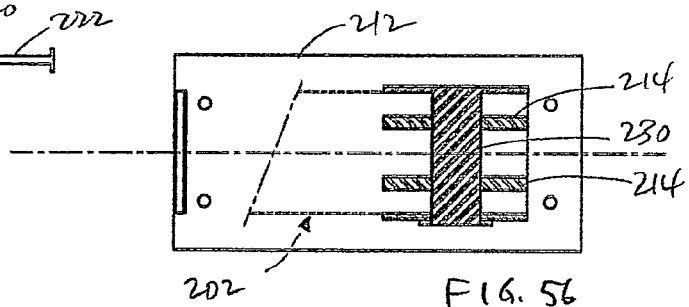
FIG. 56 is a transverse section view taken along line 56-56 of FIG. 54.
Figure 55:
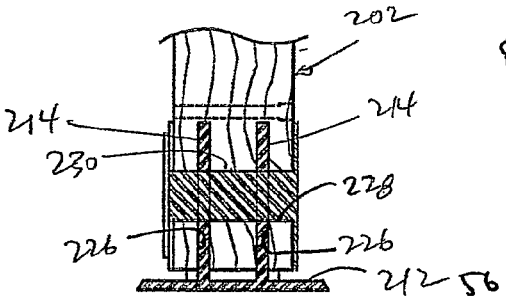
FIG. 55 is a partial section view taken along line 55-55 of FIG. 54.
Figure 54:
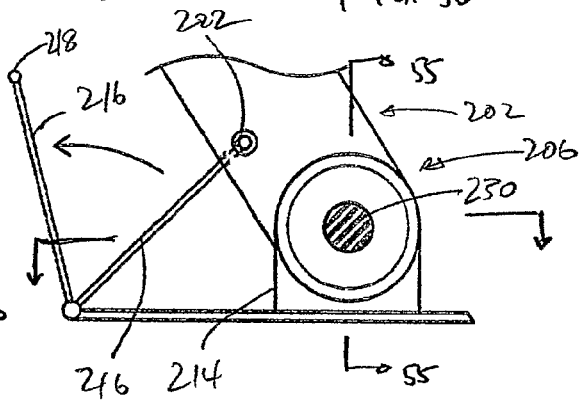
FIG. 54 is an enlarged partial side elevation view showing a pivot connection at the lower end of the central support incorporated in the desk-type support of FIGS. 42-44.
Figure 61:
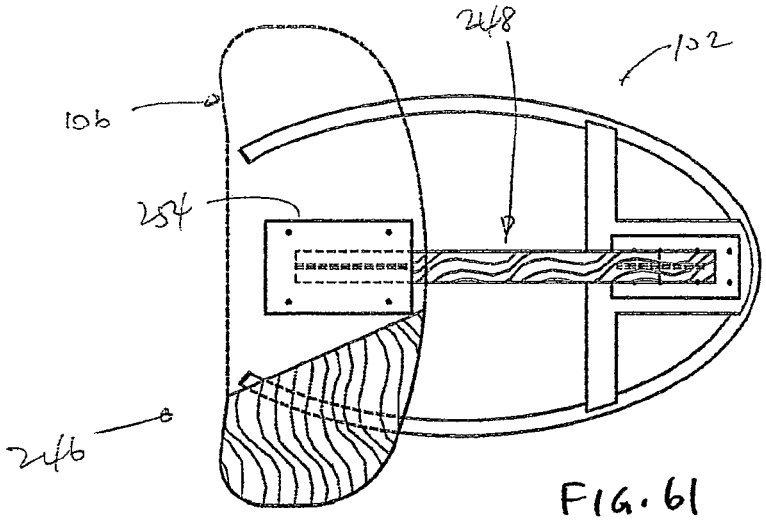
FIG. 61 is a top plan view of the desk-type support of FIGS. 59 and 60.
Figure 60:
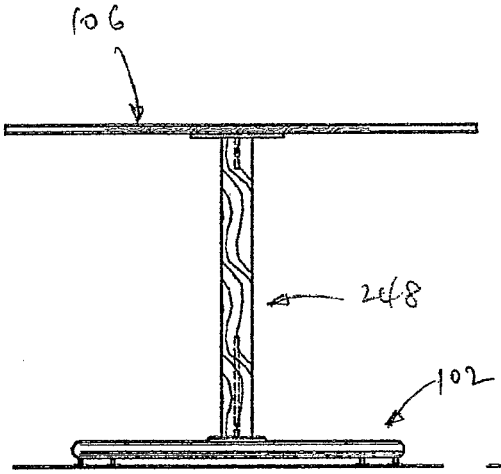
FIG. 60 is an end elevation view of the desk-type support of FIG. 59.
Figure 59:
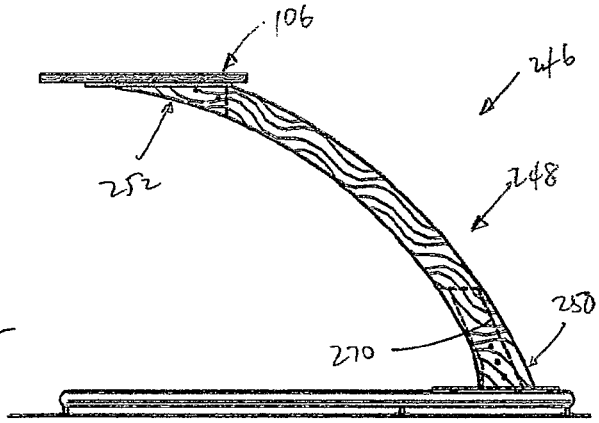
FIG. 59 is a side elevation view of another embodiment of a desk-type support in accordance with the present invention.
Figure 62:
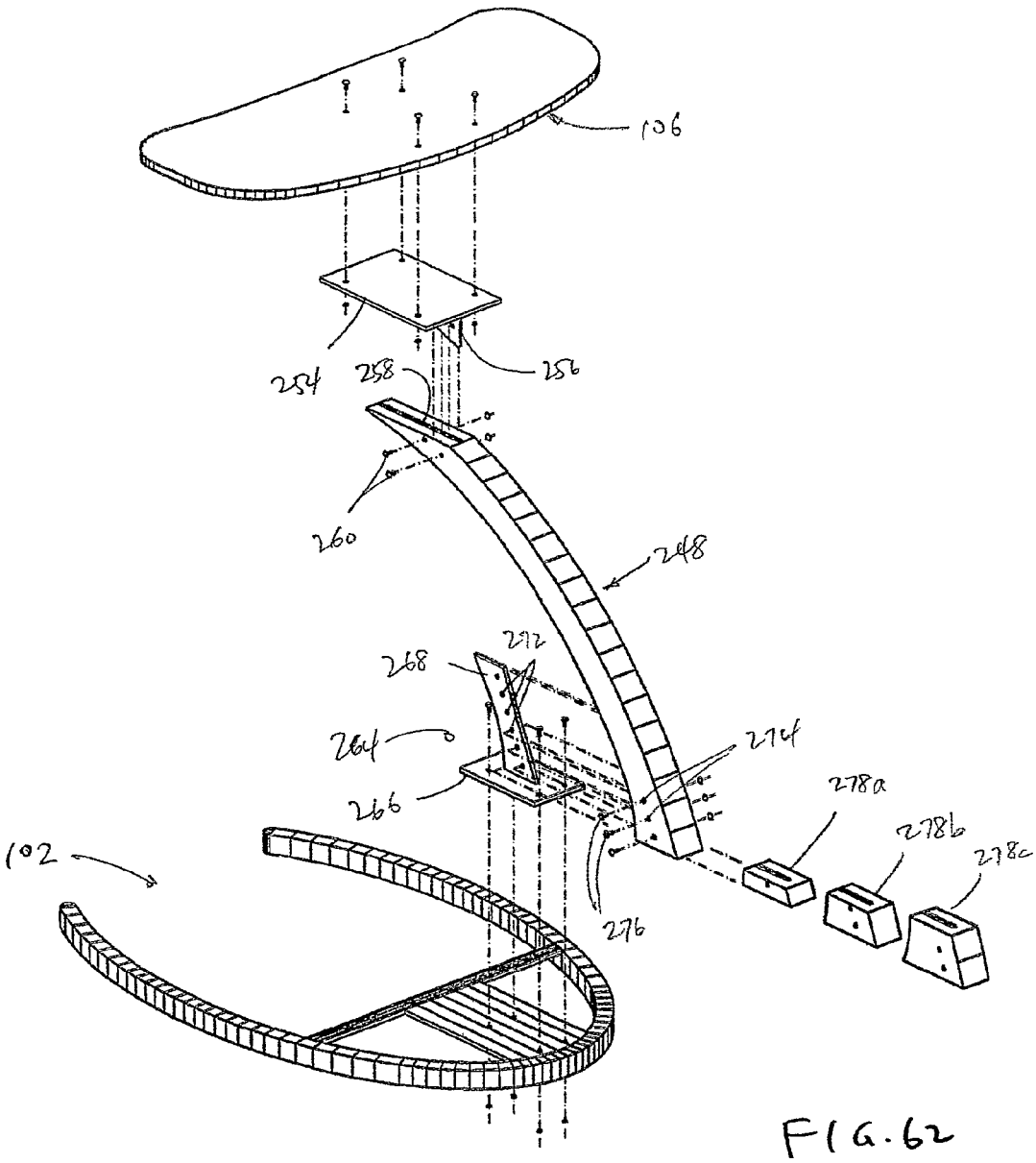
FIG. 62 is an exploded isometric view of the desk-type support of FIGS. 59-61.
Figure 64:
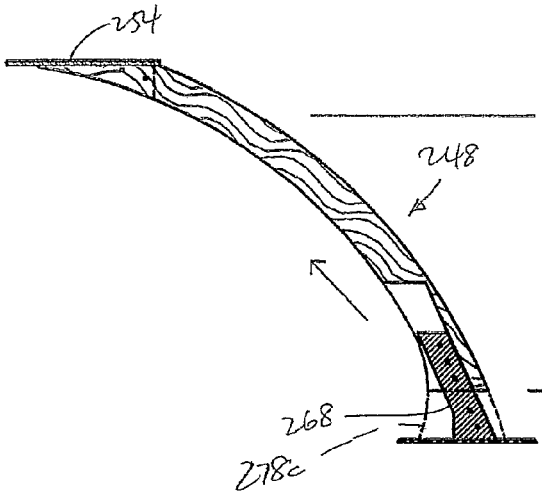
FIG. 64 is a view similar to FIG. 63, showing adjustment in the height of the central support member.
Figure 63:
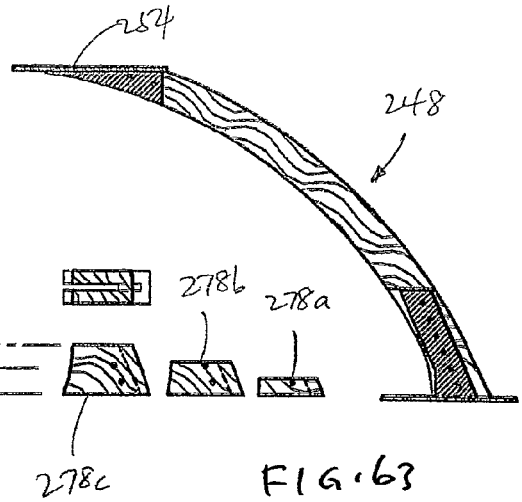
FIG. 63 is a side elevation view, with portions broken away, showing a central support member incorporated in the desk-type support of FIGS. 59-61 and a height adjustment arrangement for use therewith.
Figure 67:
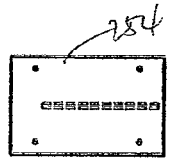
FIG. 67 is a top plan view of the desk top mounting member of FIG. 66.
Figure 65:
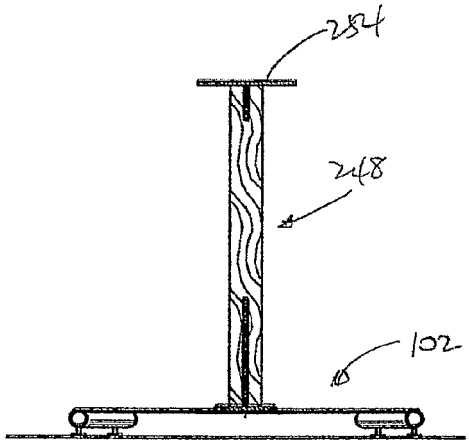
FIG. 65 is an end elevation view of the central support member of FIG. 63.
Figure 68:
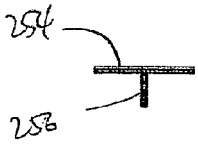
FIG. 68 is an end elevation view of the desk top mounting member of FIG. 66.
Figure 66:
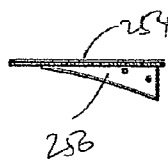
FIG. 66 is a side elevation view of an adjustable height desk top mounting member incorporated in the central support member of FIG. 63.
Figure 70:
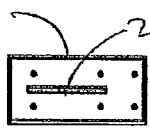
FIG. 70 is a top plan view of the base mounting member of FIG. 69.
Figure 71:
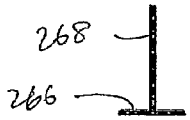
FIG. 71 is an end elevation view of the base mounting member of FIG. 69.
Figure 69:
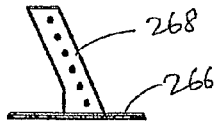
FIG. 69 is a side elevation view of a base mounting member incorporated in the central support member of FIG. 63.
Figure 73:
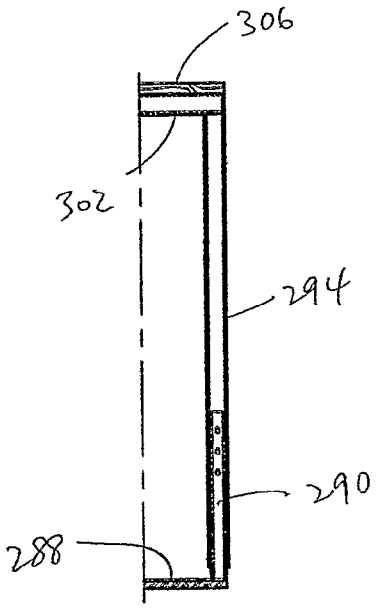
FIG. 73 is a partial section view illustrating a portion of a leg incorporated in the desk-type support of FIG. 72.
Figure 72:
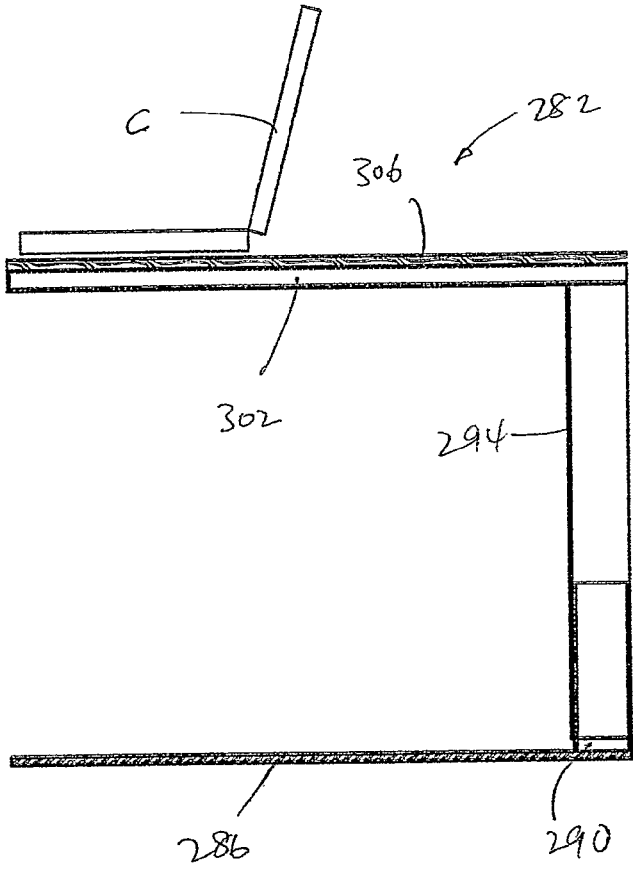
FIG. 72 is a side elevation view of another embodiment of a desk-type support in accordance with the present invention.
Figure 74:
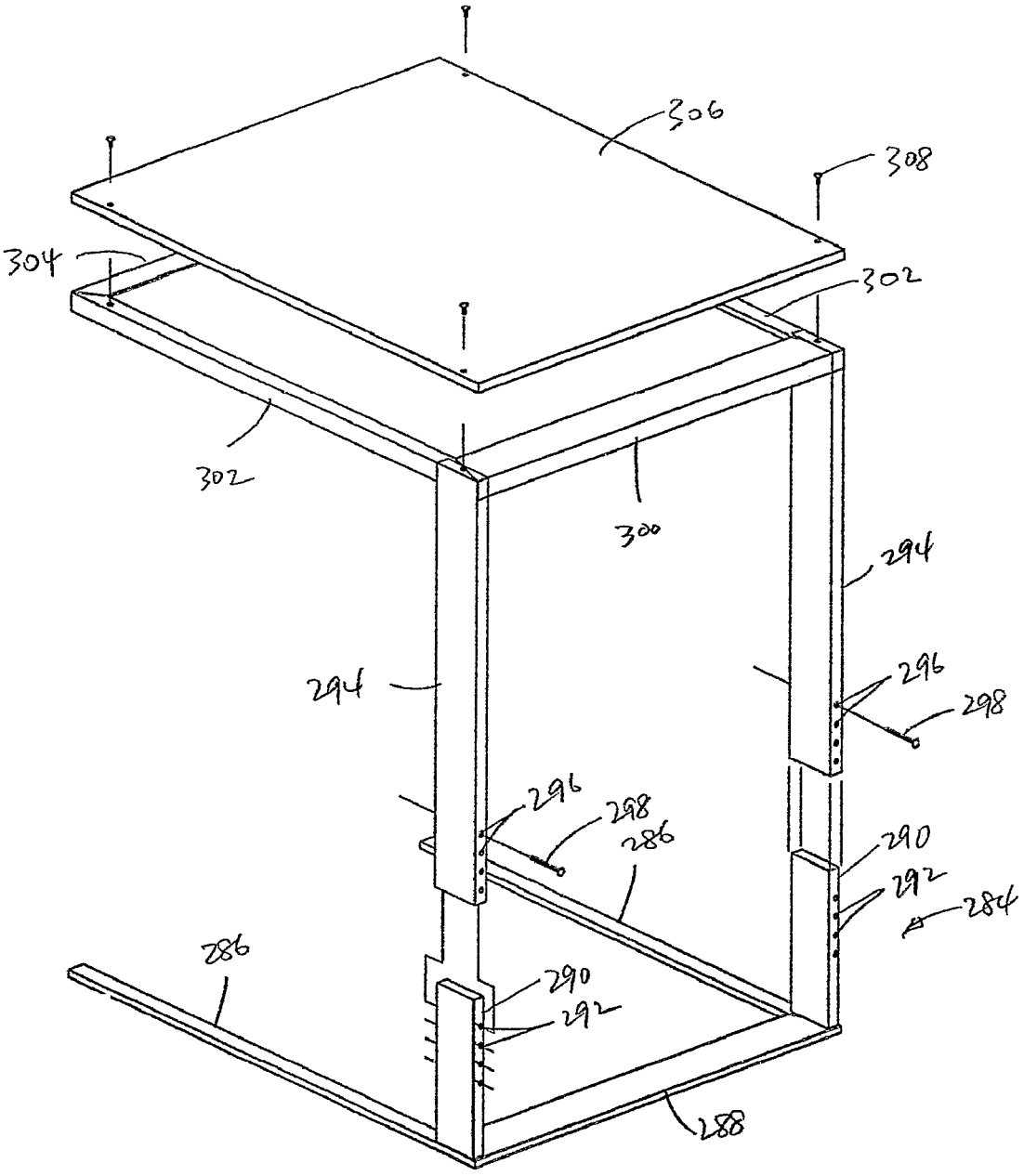
FIG. 74 is an exploded isometric view of the desk-type support of FIG. 72.
Figure 78:
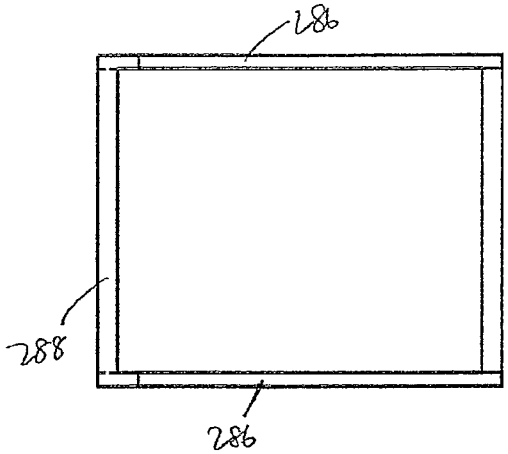
FIG. 78 is a bottom plan view of the desk-type support of FIG. 72.
Figure 77:
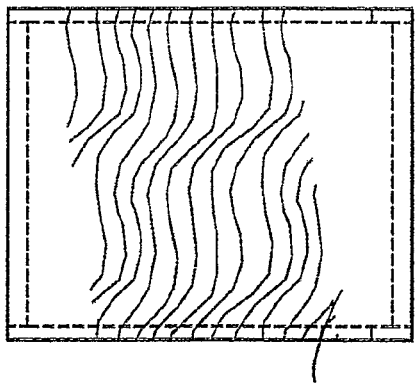
FIG. 77 is a top plan view of the desk-type support of FIG. 72.
Figure 76:
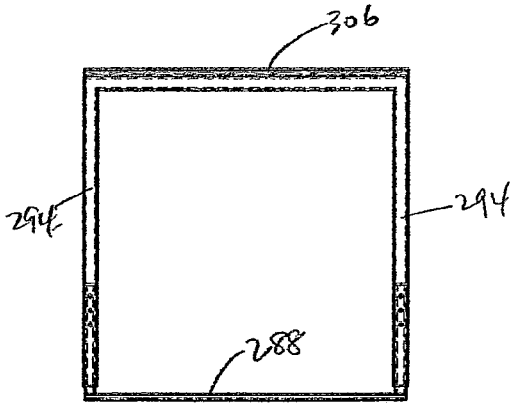
FIG. 76 is an end elevation view of the desk-type support of FIG. 72.
Figure 75:
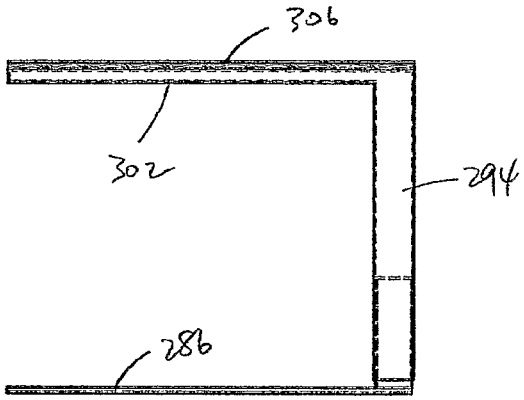
FIG. 75 is a side elevation view similar to FIG. 72.

As shown in FIG. 46, lower pivot connection 206 includes a base plate 212 that is mounted to axial section 118 of rear bracket 116. A pair of mounting ears 214 extend upwardly from base plate 212, and define aligned, transversely facing openings. A locking plate 216 is pivotably mounted to the front edge of base plate 212 for movement between a raised, operative position and a lowered, inoperative position. Locking plate 216 includes a transverse tube 218 at its outer end. Lower end 204 of support member 202 includes a recess within which the outer end of locking plate 216 is received, and a pair of transverse passages 220 located on opposite sides of the recess between which tube 218 is positioned when locking plate 216 is in its operative position. A locking pin 222 is engaged through the aligned passages 220 and extends through the passage of tube 218, for selectively maintaining locking plate 216 in the raised, operative position.

Lower end 204 of support member 202 includes a pair of slots 226 within which mounting ears 214 are received, and a transverse passage 228 that is aligned with the openings in mounting ears 214 when mounting ears 214 are received within slots 226. A pivot pin 230 extends through passage 228 and the aligned openings in mounting ears 214, for pivotably mounting lower end 204 of support member 202 to base 102.

As shown in FIG. 46, a desk top plate 232 is secured to the underside of desk top member 106. Desk top plate 232 is hinged to a desk top mounting member 234, which includes a support plate 236 and a desk top mounting plate 238. A hinge pin 240 extends through aligned hinge tube sections mounted to the rear edge of desk top plate 232 and support plate 236, for providing pivoting movement of desk top member 106 relative to support member 202 about a pivot axis defined by hinge pin 240. As in the prior embodiments, the upper end 208 of support member 202 includes a forwardly and upwardly open slot within which desk top mounting plate 238 can be moved axially to adjust the height of desk top member 106. One of a series of spacers 242*a-c* is engaged between the underside of support plate 236 and the upper end of support member 202, to occupy the space created by vertical adjustment of desk top member 106, in the same manner as described previously.

Figure 42:
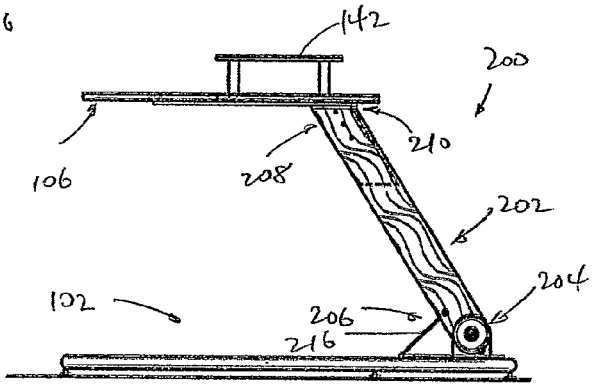
FIG. 42 is a side elevation view of another embodiment of a desk-type support in accordance with the present invention.
Figure 45A:
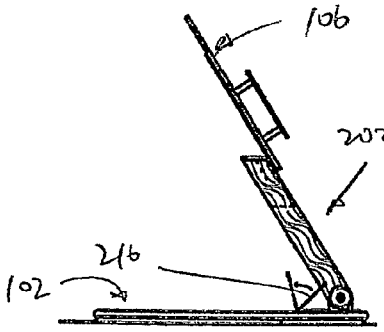
FIGS. 45A-45C are side elevation views of the desk-type support of FIGS. 42-44, showing the manner in which the support can be placed in a collapsed or folded condition for storage.
Figure 45B:
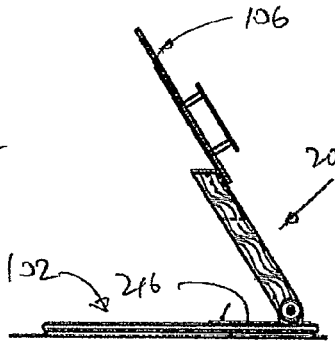
Figure 45C:
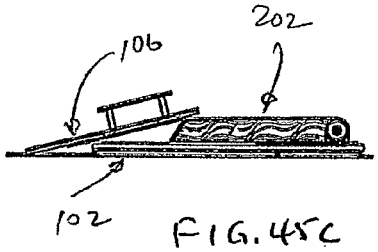

In operation, desk-type support 200 is movable from an operative position as shown in FIG. 42 to a folded or collapsed condition as shown in FIG. 45C. To accomplish this, the user withdraws locking pin 222 from tube 218 at the outer end of locking plate 216, so as to disengage the connection between locking plate 216 and support member 202. The user then pivots locking plate 216 away from support member 202 to a lowered position, and folds support member 202 downwardly against base 102, as shown in FIG. 45C. The pivot connection between desk top plate 232 and support plate 236 enables desk top member 106 to be pivoted to a position in line with support member 202, to provide a flat configuration to desk-type support 200 when folded. The user reverses the above steps to return support 200 to the operative position as shown and described above.

FIGS. 59-70 illustrate a desk-type support 246, which includes base 102 and desk top member 106 as shown in FIGS. 7 and 8, although it is understood that any other satisfactory desk top configuration may be employed. In this embodiment, an arcuate support member 248 defines a lower end 250 secured to base 102, and an upper end 252 to which desk top member 106 is secured. A desk top mounting plate 254 is secured to the underside of desk top member 106, and includes a generally triangular mounting member 256 that extends downwardly from the underside of mounting plate 254. An upwardly open slot 258 is formed in the upper horizontal surface of support member 248, and mounting member 256 is received within slot 258. Transverse fasteners 260 extend through aligned passages in upper end 252 of support member 248 and through openings in mounting member 256, to secure desk top 106 in position.

Lower end 250 of support member 248 is secured to base 102 via a base mounting member 264 having a base plate 266 and a mounting plate 268. Lower end 250 of support member 248 includes a forwardly and downwardly open slot 270, within which mounting plate 268 is received. Mounting plate 268 includes a series of vertically spaced openings 272, and lower end 250 of support member 248 includes a series of transverse passages 274 fasteners such as 276 that extend through passages 274 into aligned ones of openings 272, to fix lower end 250 of support member 248 to base mounting member 256. The elevation of desk top member 106 can be adjusted by raising lower end 250 of support member 248 above the upper surface of base plate 266 and positioning passages 274 in alignment with upper ones of openings 272 in mounting plate 268, as noted previously with respect to the height adjustment arrangement at the support member upper end. In this embodiment, one of a series of variable height spacers 278*a-c* is positioned between the downwardly facing surface of support member lower end 250 and the upwardly facing surface of base plate 266, to fill the space created by the adjustment in elevation of support member 248. Each of spacers 278*a-c* includes a slot within which the lower area of mounting plate 268 is received. Spacers 278*a-c* have a cross section that corresponds to that of support member 248, and functions to both fill the space between support member lower end 250 and base plate 266 and to provide structural support.

FIGS. 72-78 illustrate a desk-type support 282 having a generally C-shaped configuration when viewed from the side. Support 282 includes a base 284 having a pair of base members 286 that extend parallel to each other in a front-rear direction, in combination with a cross member 288 that extends between and interconnects the rear ends of base members 286. Base 284 further includes an upstanding mounting member 290 that extends upwardly from each corner of base 284 defined by the intersection between cross member 288 and each base member 286. Each mounting member 290 includes a series of passages 292.

In this embodiment, the upwardly extending support is defined by a pair of support members 294, each of which is adapted for engagement with one of mounting members 290 via a downwardly open passage in the lower end of the support member 294. In this manner, support members 294 are engaged with mounting members 290 so as to enable telescoping movement of support members 294 relative to base 284. Each support member 294 includes a series of vertically spaced passages 296. One or more fasteners or pins 298 are engaged within selected aligned passages 292 and 296, for securing support members 294 in a desired position on mounting members 290.

An upper cross member 300 extends between and interconnects the upper ends of support members 294. A desk top support 302 extends forwardly from the corners defined by cross member 300 and the upper ends of support members 294. A rear cross member 304 connects the forward ends of desk top supports 302. A desk top member 306 is mounted to rear cross member 300, desk top supports 302 and front cross member 304 in any satisfactory manner, such as by fasteners 308. While desk top member 306 is illustrated as having a rectangular shape, it is understood that a desk top member having any other shape or configuration may be employed.

It can thus be appreciated that the various embodiments of the cantilevered desk-type support of the present invention provide a simple and aesthetically pleasing means for a user to comfortably operate a laptop of other computer-related device when in a seated position, such as on a sofa, casual chair or the like. The height adjustment capability enables a user to comfortably position the laptop or other device at a desired elevation, according to the height of the seating unit and the user's physical characteristics. The base can be slid under the seating furniture, and the upwardly extending support is configured so as to provide clearance for the user's legs.

While the invention has been shown and described with respect to a limited number of preferred embodiments, it is contemplated that certain details may vary from the specific construction as disclosed, while still falling within the scope of the present invention. For example, and without limitation, while the majority of the components of the desk are described and illustrated and being formed with a rectangular cross section, it is contemplated that circular or other geometric configurations may be utilized. Furthermore, it is further contemplated that the desk could include low profile concealed wheels to assist the user in moving the desk. Further, while screws have been disclosed as a preferred connection means, it is understood that any means of connection such as a nut and bolt, rivet, or any other means of attachment as known in the art could be utilized. In addition, it is also contemplated that the individual components could be formed separately or integrally connected. Finally, it is understood that numerous materials could be used to construct the preferred embodiments, including but not limited to wood, plastic, metal or glass.

Various alternatives and embodiments are contemplated as being within the scope of the following claims particularly pointing out and distinctly claiming the subject matter regarded as the invention.

I claim:

1. A desk, comprising:

a base adapted to rest on a support surface such as a floor, wherein the base defines a front area and a rear area, and includes a pair of horizontally oriented laterally spaced apart base members that engage the support surface and extend in a front-rear direction, wherein the base members are interconnected with each other toward the rear area of the base;

an upwardly extending support that defines a lower end interconnected with the base and an upper end spaced vertically above the lower end, wherein the lower end of the upwardly extending support is interconnected with the base at the rear area of the base;

a desk top member secured to the upper end of the upwardly extending support;

wherein the base, the upwardly extending support and the desk top member are separate components, wherein the lower end of the upwardly extending support is interconnected with the base via a base connection and wherein the desk top member is secured to the upper end of the upwardly extending support via a desk top connection;

a height adjustment arrangement incorporated in one of the base connection and the desk top connection for adjusting the height of the desk top member relative to the base, wherein the height adjustment arrangement comprises a telescoping mounting member associated with one of the base and the desk top, and a variable position engagement arrangement between the mounting member and the adjacent end of the upwardly extending support, wherein the variable position engagement arrangement is engageable with the telescoping mounting member in a plurality of positions to vary the height of the desk top, and wherein a laterally open space is defined between either the base or the desk top and the adjacent end of the upwardly extending support when the vertical position of the desk top is adjusted upwardly relative to the base via the variable position engagement arrangement; and a spacer engaged within the space and secured within the space against lateral movement;

wherein the upwardly extending support and the desk top member are configured and arranged such that the desk top member is located forwardly of the rear area of the base and the area below the desk top member between the desk top member and the base is open, whereby the base can be moved on the support surface to position the desk top member over a user's lap when the user is in a seated position.

2. The desk of claim 1, wherein the spacer defines a cross section that matches the cross section of the upwardly extending support, and wherein the spacer includes a recess within which the mounting member is received.

3. The desk of claim 2, wherein the recess comprises a vertical slot and wherein the spacer is configured for push-on engagement within the space by moving the spacer between base or the desk top and the adjacent end of the upwardly extending support using a push-on motion that positions the mounting member within the vertical slot of the spacer, and wherein the spacer is secured within the space against lateral movement by one or more fasteners that secure the spacer to the mounting member.

4. The desk of claim 1, wherein the base is configured such that the pair of base members are generally parallel to each other, wherein the rear area of the base includes a transversely extending rear member that extends between and interconnects the base members at the rear area of the base.

5. The desk of claim 4, wherein the pair of base members and the rear member are oriented in a horizontal plane, and wherein the upwardly extending support comprises a pair of vertical support members, wherein each vertical support member extends upwardly from a corner defined at a connection between the rear member and one of the base members.

6. The desk of claim 5, wherein the desk top is secured to a desk top support that extends forwardly from an upper end defined by each of the pair of vertical support members.

7. The desk of claim 1, further comprising a base pivot connection between the base and the upwardly extending support and a desk top pivot connection between the desk top and the upwardly extending support, wherein the base pivot connection and the desk top pivot connection are operable to enable the desk to be placed in a collapsed condition for storage.

8. The desk of claim 1, wherein the pair of horizontally oriented laterally spaced apart base members comprise a pair of arcuate base members that are interconnected together at the rear area of the base, wherein each of the arcuate base members extends laterally outwardly and forwardly from the rear area of the base.

9. The desk of claim 8, wherein the base further includes a T-shaped rear member having an axial member and a transverse member, wherein the transverse member defines a pair of ends, each of which is secured to one of the arcuate base members.

10. The desk of claim 9, wherein the axial member of the T-shaped rear member is connected at a rear connection area defined between the pair of arcuate base members.

11. The desk of claim 8, wherein the upwardly extending support comprises a central cantilevered member defining a lower rear end secured to the rear area of the base and an upper forward end to which the desk top member is mounted.

12. The desk of claim 11, wherein the height adjustment arrangement is associated with the central cantilevered member for adjusting the height of the desk top member relative to the base.

13. A method of positioning a worksurface above a supporting surface such as a floor, comprising the acts of:

providing a desk having a base defining a front area and a rear area, wherein the base includes a pair of horizontally oriented laterally spaced apart base members that engage the support surface and extend in a front-rear direction, wherein the base members are interconnected with each other toward the rear area of the base; an upwardly extending support that defines a lower end interconnected with the base and an upper end spaced vertically above the lower end, wherein the lower end of the upwardly extending support is interconnected with the base at the rear area of the base; and a desk top member secured to the upper end of the upwardly extending support; wherein the upwardly extending support and the desk top member are configured and arranged such that the desk top member is located forwardly of the rear area of the base and the area below the desk top member between the desk top member and the base is open;

selectively adjusting the height of the desk top member relative to the base using a telescoping connection between the upwardly extending support and one of the desk top member and the base, wherein the telescoping connection includes a telescoping mounting member associated with one of the base and the desk top, and a variable position engagement arrangement between the mounting member and the adjacent end of the upwardly extending support, wherein the act of adjusting the height of the desk top member via the telescoping connection includes securing the mounting member to the variable position engagement arrangement in one of a plurality of selected positions, and wherein the act of adjusting the height of the desk top member creates a laterally open space between an end area of the upwardly extending support and either the desk top member or the base;

placing a spacer within the space and securing the spacer within the space against lateral movement; and positioning the base on the support surface such that the desk top member is located over a user's lap when the user is in a seated position.

14. The method of claim 13, wherein the spacer is selected from a group of spacers, each of which has a different height, so as to accommodate spaces of differing heights that are created when the height of the desk top member is adjusted.

15. The method of claim 14, wherein the upwardly extending support comprises a single cantilever member that extends upwardly and forwardly from the rear area of the base, and wherein the telescoping connection includes a recess in an end area defined by the single cantilever member and wherein the mounting member extends from either the desk top member or the base into the recess, and wherein each spacer includes a laterally open slot within which the mounting member is received when the spacer is positioned within the space.

16. The method of claim 13, wherein the act of securing the spacer within the space against lateral movement is carried out by securing the spacer to the mounting member using one or more fasteners.

* * * * *